US007993492B2

(12) United States Patent
Cabrera Y Lopez Caram

(10) Patent No.: US 7,993,492 B2
(45) Date of Patent: Aug. 9, 2011

(54) FIBER MAT FORMING APPARATUS AND METHOD OF PRESERVING THE HYDRODYNAMIC PROCESSES NEEDED TO FORM A PAPER SHEET

(75) Inventor: Luis Fernando Cabrera Y Lopez Caram, Mexico (MX)

(73) Assignee: FC Papel LLC, Austin, TX (US)

( * ) Notice: Subject to any disclaimer, the term of this patent is extended or adjusted under 35 U.S.C. 154(b) by 351 days.

(21) Appl. No.: 12/278,060

(22) PCT Filed: Jan. 31, 2007

(86) PCT No.: PCT/IB2007/000224

§ 371 (c)(1),
(2), (4) Date: Dec. 10, 2008

(87) PCT Pub. No.: WO2007/088456

PCT Pub. Date: Aug. 9, 2007

(65) Prior Publication Data

US 2009/0301677 A1 Dec. 10, 2009

Related U.S. Application Data

(60) Provisional application No. 60/765,247, filed on Feb. 3, 2006, provisional application No. 60/778,871, filed on Mar. 3, 2006, provisional application No. 60/811,039, filed on Jun. 5, 2006, provisional application No. 60/811,628, filed on Jun. 7, 2006.

(51) Int. Cl.
*D21F 1/54* (2006.01)
*D21F 1/52* (2006.01)

(52) U.S. Cl. ..... 162/211; 162/352

(58) Field of Classification Search ..... 162/208, 162/209, 211, 351, 352, 374
See application file for complete search history.

(56) References Cited

U.S. PATENT DOCUMENTS

| | | | | |
|---|---|---|---|---|
| 3,573,159 | A * | 3/1971 | Sepall | 162/208 |
| 3,598,694 | A * | 8/1971 | Wiebe | 162/351 |
| 3,738,911 | A | 6/1973 | Kienzl et al. | |
| 3,823,062 | A | 7/1974 | Ward et al. | |
| 3,870,597 | A | 3/1975 | Getman et al. | |
| 3,874,998 | A * | 4/1975 | Johnson | 162/308 |
| 3,922,190 | A | 11/1975 | Cowan | |

(Continued)

FOREIGN PATENT DOCUMENTS

WO WO 95/30048 11/1995

OTHER PUBLICATIONS

International Search Report issued by USPTO for corresponding International Application PCT/IB07/00224 mailed Mar. 30, 2009.

*Primary Examiner* — Eric Hug
(74) *Attorney, Agent, or Firm* — Frommer Lawrence & Haug LLP; Ronald R. Santucci

(57) ABSTRACT

The invention relates to an apparatus used in the formation of paper. More specifically the present invention is directed to an apparatus for maintaining the hydrodynamic processes involved in the formation of a fiber mat or paper sheet. The performance of this apparatus is not affected by the velocity of the paper machine, the basis weight of the paper sheet and or the thickness of the mat being formed.

21 Claims, 32 Drawing Sheets

U.S. PATENT DOCUMENTS 4,123,322 A * 10/1978 Hoult ..... 162/352
4,425,189 A 1/1984 Mimura
4,459,176 A 7/1984 Goodnow
4,544,449 A 10/1985 Arav
4,687,549 A * 8/1987 Kallmes ..... 162/352
4,789,433 A * 12/1988 Fuchs ..... 162/352
4,838,996 A * 6/1989 Kallmes ..... 162/352
4,909,906 A 3/1990 Bartelmuss et al.
5,011,577 A 4/1991 Hansen et al.
5,089,090 A 2/1992 Hansen
5,169,500 A 12/1992 Mejdell
5,242,547 A 9/1993 Corbellini et al.
5,387,320 A 2/1995 Jaakkola
5,389,207 A 2/1995 Rodriguez et al.
5,393,382 A 2/1995 Corbellini et al.
5,437,769 A 8/1995 Bando et al.
5,735,330 A * 4/1998 Buchmann et al. ..... 162/301
5,830,322 A * 11/1998 Cabrera y Lopez Caram et al. ..... 162/209
5,951,823 A 9/1999 Cabrera Y Lopez Caram et al.
6,030,501 A * 2/2000 Neun et al. ..... 162/352
6,126,786 A * 10/2000 White et al. ..... 162/209
6,372,093 B1 * 4/2002 Brewer ..... 162/352
6,988,018 B2 * 1/2006 Eames ..... 700/129

* cited by examiner

FIBER MAT FORMING APPARATUS AND METHOD OF PRESERVING THE HYDRODYNAMIC PROCESSES NEEDED TO FORM A PAPER SHEET

This application is a 371 of PCT/IB2007/000224 filed on Jan. 31, 2007, published on Aug. 9, 2007 under publication number WO 2007/088456 A which claims priority benefits from U.S. Provisional Patent Application Ser. No. 60/765,247 filed Feb. 3, 2006 and U.S. Provisional Patent Application Ser. No. 60/778,871 filed Mar. 3, 2006 and U.S. Provisional Patent Application Ser. No. 60/811,039 filed Jun. 5, 2006 and U.S. Provisional Patent Application Ser. No. 60/811,628 filed Jun. 7, 2006, the disclosures of which are hereby incorporated by reference.

FIELD OF THE INVENTION

The present invention is directed to an apparatus used in the formation of paper. More specifically the present invention is directed to an apparatus for maintaining the hydrodynamic processes involved in the formation of a fiber mat. The performance of this apparatus is not affected by the velocity of the paper machine, the basis weight of the paper sheet and or the thickness of the mat being formed.

BACKGROUND OF THE INVENTION

In general, it is well known in papermaking industry that proper drainage of liquid from the paper stock on a forming fabric is an important step to insure a quality product. This is done through the use of drainage blades or foils usually located at the wet end of the machine, e.g. a Fourdrinier paper machine. (Note the term drainage blade, as used herein, is meant to include blades or foils that cause drainage or stock activity or both.) A wide variety of different designs for these blades are available today. Typically, these blades provide for a bearing surface for the wire or forming fabric with a trailing portion for dewatering, which angles away from the wire. This creates a gap between the blade surface and the fabric which causes a vacuum between the blade and the fabric. This not only drains water out of the fabric, but also can result in pulling the fabric down. When the vacuum collapses, the fabric returns to its position which can result in a pulse across the stock, which may be desirable for stock distribution. The activity (caused by the wire deflection) and the amount of water drained from the sheet are directly related to vacuum generated by the blade, and therefore to each other. Drainage and activity by such blades can be augmented by placing the blade or blades on a vacuum chamber. The direct relationship between drainage and activity is not desirable because while activity is always desirable, too much drainage early in the sheet formation process may have adverse effects on retention of fibers and filler. Rapid drainage may also cause sheet sealing, making subsequent water removal more difficult. Existing technology forces the paper maker to compromise desired activity in order to slow early drainage.

Drainage can be accomplished by way of a liquid to liquid transfer such as that taught in U.S. Pat. No. 3,823,062 to Ward, which is incorporated herein by reference. This reference teaches the removal of liquid through sudden pressure shocks to the stock. The reference states that controlled liquid to liquid drainage of water from the suspension is less violent than conventional drainage.

A similar type of drainage is taught in U.S. Pat. No. 5,242,547 to Corbellini. This patent teaches preventing the formation of a meniscus (air/water interface) on the surface of the forming fabric opposite the sheet to be drained. This reference achieves this by flooding the vacuum box structure containing the blade(s) and adjusting the draw off of the liquid by a control mechanism. This is referred to as "Submerged Drainage." Improved dewatering is said to occur through the use of sub-atmospheric pressure in the suction box.

In addition to drainage, blades are constructed to purposely create activity in the suspension in order to provide for desirable distribution of the flock. Such a blade is taught, for example, in U.S. Pat. No. 4,789,433 to Fuchs. This reference teaches the use of a wave shaped blade (preferably having a rough dewatering surface) to create microturbulence in the fiber suspension.

Other types of blades wish to avoid turbulence, but yet effect drainage, such as that described, for example, in U.S. Pat. No. 4,687,549 to Kallmes. This reference teaches filling the gap between the blade and the web and states that the absence of air prevents expansion and cavitation of the water in the gap and substantially eliminates any pressure pulses. A number of such blades and other arrangements can be found in the following prior art: U.S. Pat. Nos. 5,951,823; 5,393,382; 5,089,090; 4,838,996; 5,011,577; 4,123,322; 3,874,998; 4,909,906; 3,598,694; 4,459,176; 4,544,449; 4,425,189; 5,437,769; 3,922,190; 5,389,207; 3,870,597; 5,387,320; 3,738,911; 5,169,500 and 5,830,322, which are incorporated herein by reference.

Traditionally, high and low speed paper machines produce different grades of paper with a wide range of basis weights. Sheet forming is a hydromechanical process and the motion of the fibers follow the motion of the fluid because the inertial force of an individual fiber is small compared to the viscous drag in the liquid. Formation and drainage elements affect three principle hydrodynamic processes, which are drainage, stock activity and oriented shear. Liquid is a substance that responds according to shear forces acting in or on it. Drainage is the flow through the wire or fabric, and it is characterized by a flow velocity that is usually time dependant.

Stock activity, in an idealized sense, is the random fluctuation in flow velocity in the undrained fiber suspension, and generally appears due to a change in momentum in the flow due to deflection of the forming fabric in response to drainage forces or as being caused by blade configuration. The predominant effect of stock activity is to break down networks and to mobilize fibers in suspension. Oriented shear and stock activity are both shear-producing processes that differ only in their degree of orientation on a fairly large scale, i.e. a scale that is large compared to the size of individual fibers.

Oriented shear is shear flow having a distinct and recognizable pattern in the undrained fiber suspension. Cross Direction ("CD") oriented shear improves both sheet formation and test. The primary mechanism for CD shear (on paper machines that do not shake) is the creation, collapse and subsequent recreation of well defined Machine Direction ("MD") ridges in the stock of the fabric. The source of these ridges may be the headbox rectifier roll, the head box slice lip (see e.g., International Application PCT WO95/30048 published Nov. 9, 1995) or a formation shower. The ridges collapse and reform at constant intervals, depending upon machine speed and the mass above the forming fabric. This is referred to as CD shear inversion. The number of inversions and therefore the effect of CD shear is maximized if the fiber/water slurry maintains the maximum of its original kinetic energy and is subjected to drainage pulses located (in the MD) directly below the natural inversion points.

In any forming system, all these hydrodynamic processes may occur simultaneously. They are generally not uniformly distributed in either time or space, and they are not wholly independent of one another, they interact. In fact, each of these processes contributes in more than one way to the overall system. Thus, while the above-mentioned prior art may contribute to some aspect of the hydrodynamic processes aforesaid, they do not coordinate all processes in a relatively simple and effective way.

Stock activity in the early part of a Fourdrinier table is critical to the production of a good sheet of paper. Generally, stock activity can be defined as turbulence in the fiber-water slurry on the forming fabric. This turbulence takes place in all three dimensions. Stock activity plays a major part in developing good formation by impeding stratification of the sheet as it is formed, by breaking up fiber flocks, and by causing fiber orientation to be random.

Typically, stock activity quality is inversely proportional to water removal from the sheet; that is, activity is typically enhanced if the rate of dewatering is retarded or controlled. As water is removed, activity becomes more difficult because the sheet becomes set, the lack of water, which is the primary media in which the activity takes place, becomes scarcer. Good paper machine operation is thus a balance between activity, drainage and shear effect.

The capacity of each forming machine is determined by the forming elements that compose the table. After a forming board, the elements which follow have to drain the remaining water without destroying the mat already formed. The purpose of these elements is to enhance the work done by the previous forming elements.

As the basis weight is increased the thickness of the mat is increased. With the actual forming/drainage elements it is not possible to maintain a controlled hydraulic pulse strong enough to produce the hydrodynamic processes necessary to make a well-formed sheet of paper.

An example of conventional means for reintroducing drainage water into the fiber stock in order to promote activity and drainage can be seen in FIGS. 1-7.

A table roll 100 in FIG. 1 causes a large positive pressure pulse to be applied to the sheet 96, which results from water 94 under the forming fabric 98 being forced into the incoming nip formed by the lead in roll 92 and forming fabric 98. The amount of water reintroduced is limited to the water adhered to the surface of the roll 92. The positive pulse has a good effect on stock activity; it causes flow perpendicular to the sheet surface. Likewise, on the exiting side of the roll 90, large negative pressures are generated, which greatly motivate drainage and the removal of fines. But reduction of consistency in the mat is not noticeable, so there is little improvement through increase in activity. Table rolls are generally limited to relatively slower machines because the desirable positive pulse transmitted to the heavy basis weight sheets at specific speeds becomes an undesirable positive pulse that disrupts the lighter basis weight sheets at faster speeds.

A gravity foil 88 is shown in FIG. 2. The vacuum generated by a foil blade 86 increases with an increase in the foil angle and or the blade length. The vacuum, in this case, increases in direct proportion to the square of the machine speed. The vacuum forces generated by a foil blade increase as fiber mat 96 drainage resistance increases. Low foil blade angles, often in the range of about 0.5 to 1 degree, are used in the early part of the forming table. The angle is increased to the dry end of the table up by 3 to 4 degrees. As less water is available in machine direction, the angle selected should allow the ability of the diverging gap to be filled with water.

FIGS. 3 to 7 show low vacuum boxes 84 with different blade arrangements. A gravity foil is also used in low vacuum boxes. These low vacuum augmented units 84 provide the papermaker a tool that significantly affects the process by controlling the applied vacuum and the pulse characteristics. Examples of blade box configurations include:

Gravity foil or foil blade box 88 as shown in FIG. 2;

Flat blades or wet box (not shown);

Step blades 82 as show in FIGS. 3-5, and 7;

Offset plane blade 80 as shown in FIG. 6; and

Positive pulse step blade 78 as shown in FIG. 7.

Traditionally, the foil blade box, the offset plane blade box and the step blade box are mostly used in the forming process.

In use, a vacuum augmented foil blade box will generate vacuum as the gravity foil does, the water is removed continuously without control, and the predominant drainage process is filtration. Typically, there is no refluidization of the mat that is already formed.

In a vacuum augmented flat blade box, a slight positive pulse is generated over the blade/wire contact surface and the pressure exerted on the fiber mat is due only to the vacuum level maintained in the box.

In a vacuum augmented step blade box, as shown in FIG. 3, a variety of pressure profiles are generated depending upon factors such as, step length, span between blades, machine speed, step depth, and vacuum applied. The step blade generates a peak vacuum relative to the square of the machine speed in the early part of the blade, this peak negative pressure causes the water to drain and at the same time the wire is deflected toward the step direction, part of the already drained water is forced to move back into the mat refluidizing the fibers and breaking up the flocks due to the resulting shear forces. If the applied vacuum is higher than necessary, the wire is forced to contact the step of the blade, as shown in FIG. 4. After some time of operation in such a condition, the foil accumulates dirt 76 in the step, losing the hydraulic pulse which is reduced to the minimum, as shown in FIG. 5, and prevents the reintroduction of water into the mat.

The vacuum augmented offset plane blade box, as shown in FIG. 6 has leading/trailing and intermediate flat blades 80 at two different elevations below the wire line. The intermediate blade 80 is set below the wire line to limit the deflection of the wire under vacuum and creates a hydrodynamic nip with the water under the forming wire.

The vacuum augmented positive pulse step blade low vacuum box, as shown in FIG. 7, fluidizes the sheet by having each blade reintroduce part of the water removed by the preceding blade back into the mat. There is, however, no control on the amount of water reintroduced into the sheet.

While some of the foregoing references have certain attendant advantages, further improvements and/or alternative forms, are always desirable.

SUMMARY OF THE INVENTION

It is an object of the present invention to provide a machine for maintaining the hydrodynamic processes of a paper sheet formed thereon.

It is a further object of the present invention to provide a machine usable with a forming board and or a velocity induce drainage machine.

It is a further object of the present invention that the efficiency of the machine not be affected by the velocity of the machine, the basis weight of the paper sheet and or the thickness of the mat.

The various features of novelty which characterize the invention are pointed out in particularity in the claims annexed to and forming a part of this disclosure. For a better understanding of the invention, its operating advantages and specific objects attained by its uses, reference is made to the accompanying drawings and descriptive mater in which preferred embodiments of the invention are illustrated.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION

Figure 1:
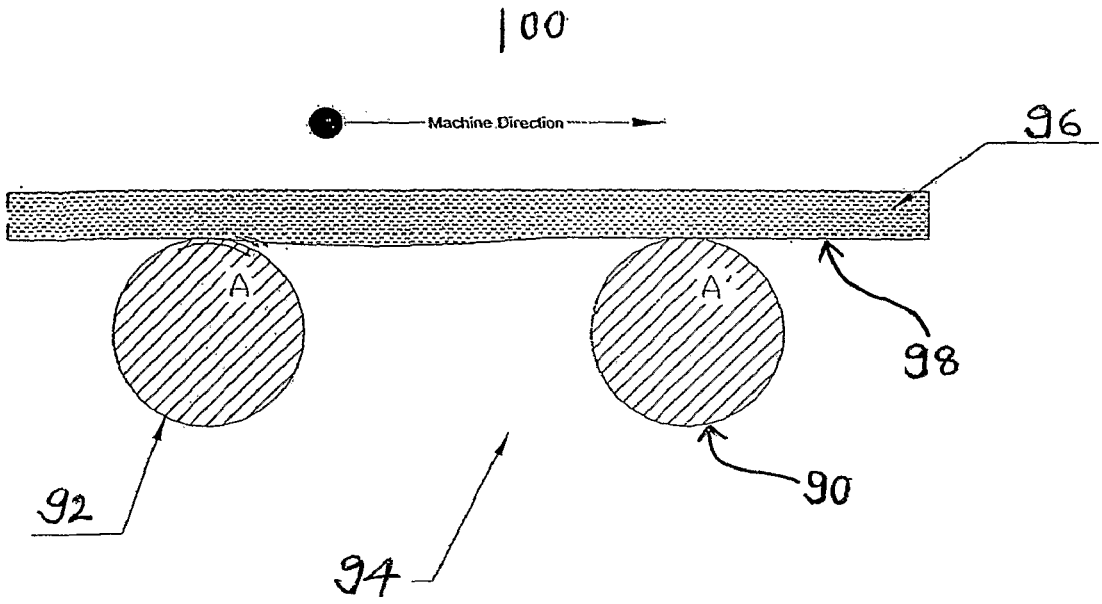
FIG. 1 Depicts a known table roll.
Figure 2:
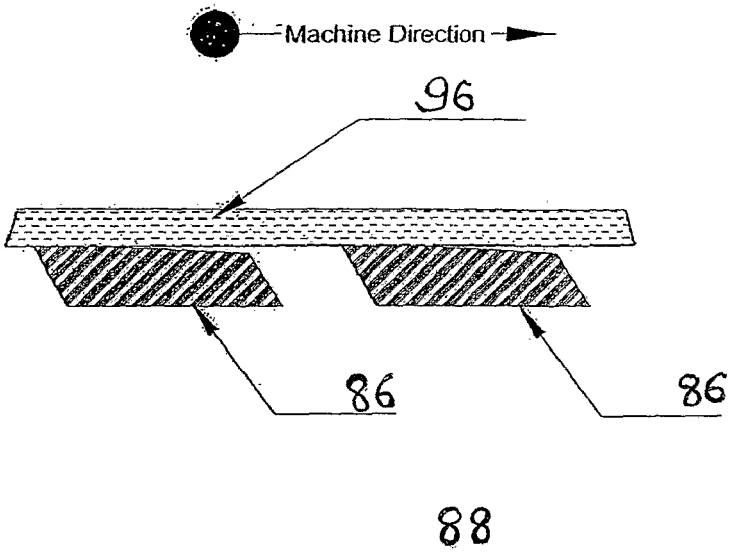
FIG. 2 Depicts a known gravity foil blade.
Figure 3:
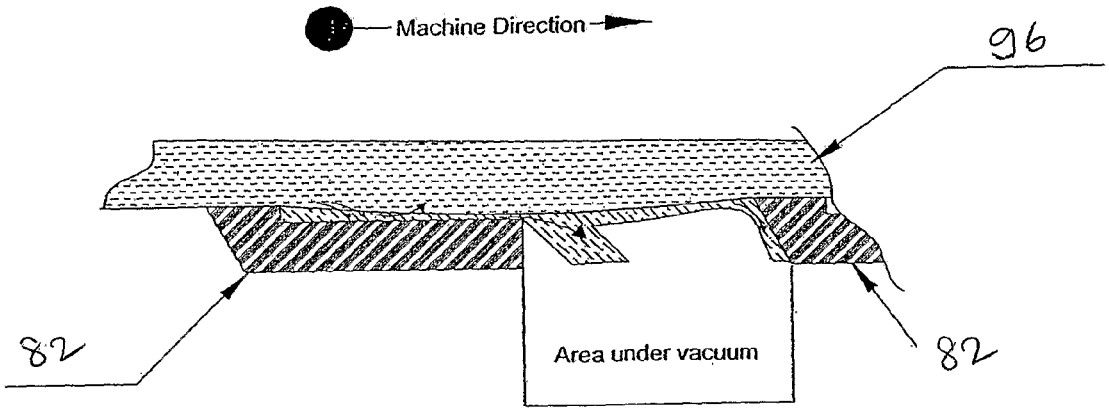
FIG. 3 Depicts a known low-vacuum box with step blade.
Figure 4:
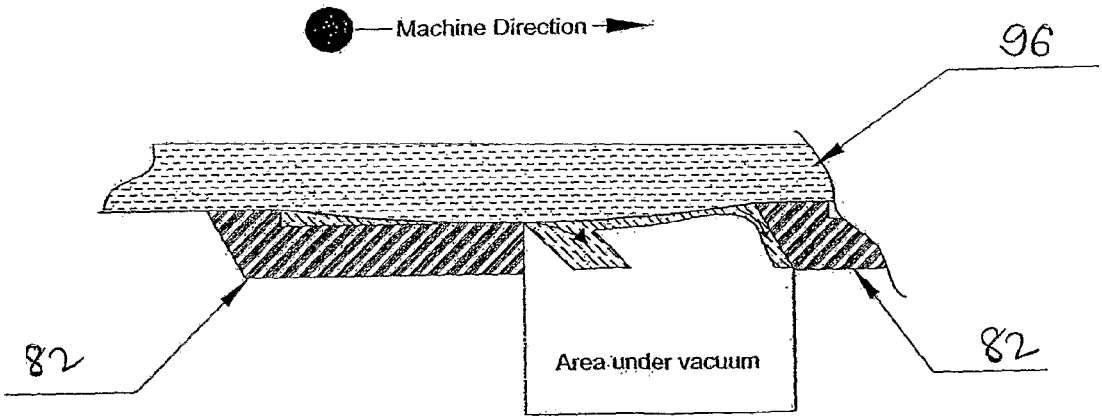
FIG. 4 Depicts a known low-vacuum box with step blade, wire touching the step.
Figure 5:
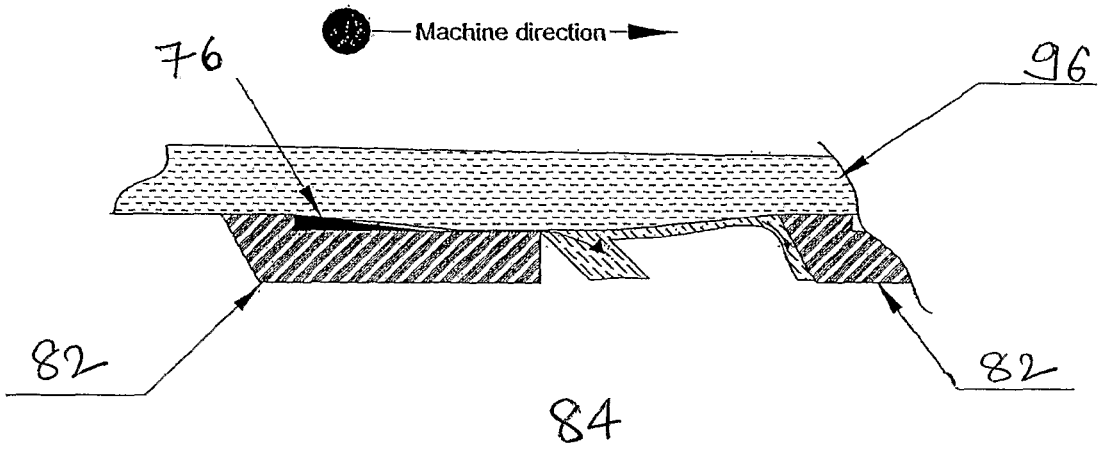
FIG. 5 Depicts a known low-vacuum box, step blade with dirt accumulation.
Figure 6:
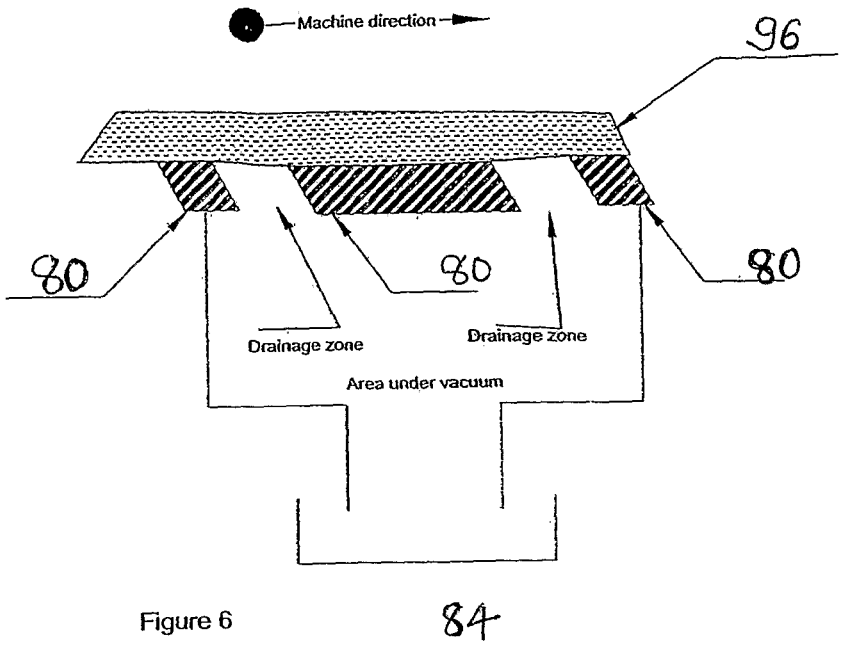
FIG. 6 Depicts a known offset-plane blade low-vacuum box.
Figure 7:
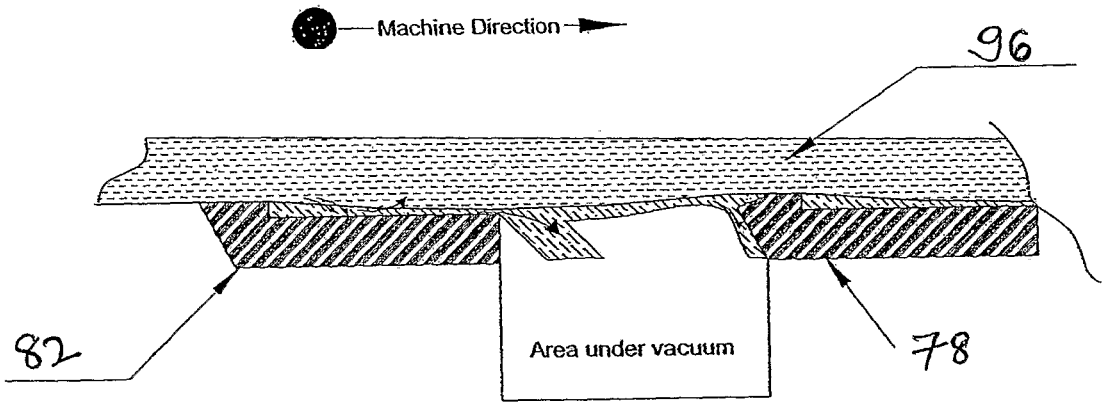
FIG. 7 Depicts a known positive pulse blade low vacuum box.
Figure 8:
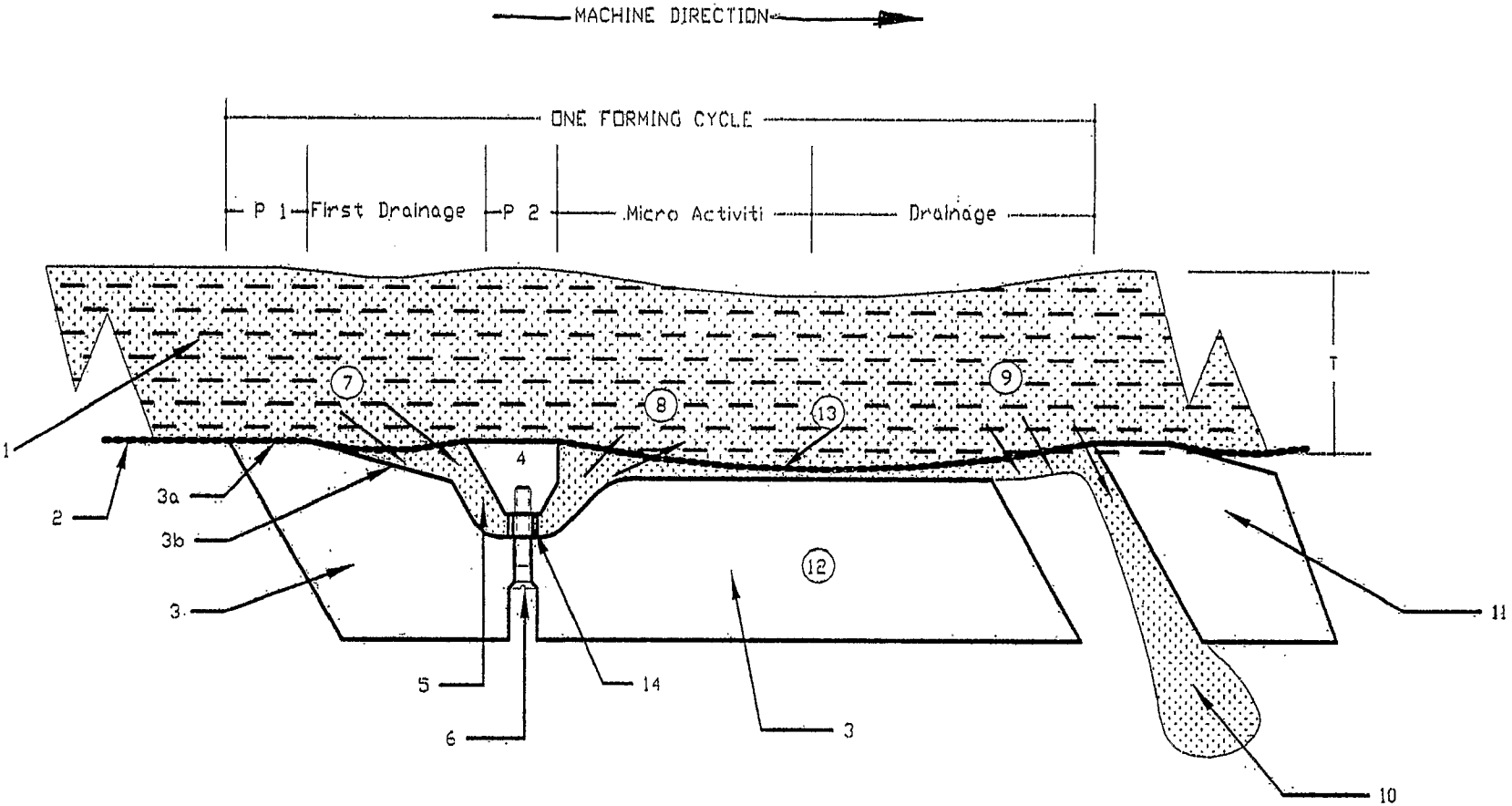
FIG. 8 Depicts a blade according to one aspect of the instant invention.

One aspect of the instant invention can be seen with reference to FIGS. 8, 9, 9*a*, 10, 10*a* and 10*b*. In FIG. 8, the body 3 includes a leading edge 3*a* which contacts the forming fabric 2. As shown in FIG. 8 the leading edge 3*a* in contact with the forming fabric is flat and parallel to the forming fabric 2. In this example, it is desirable that the leading edge 3*a* have full contact with the forming fabric. Following the leading edge 3*a* is a diverging surface 3*b*, which slopes away from the leading edge 3*a*. The angle of the diverging surface with respect to the leading edge is preferably within the range of about 0.1 to 10 degrees. However, it is preferred that the angle be less than 10 degrees.

Figure 9:
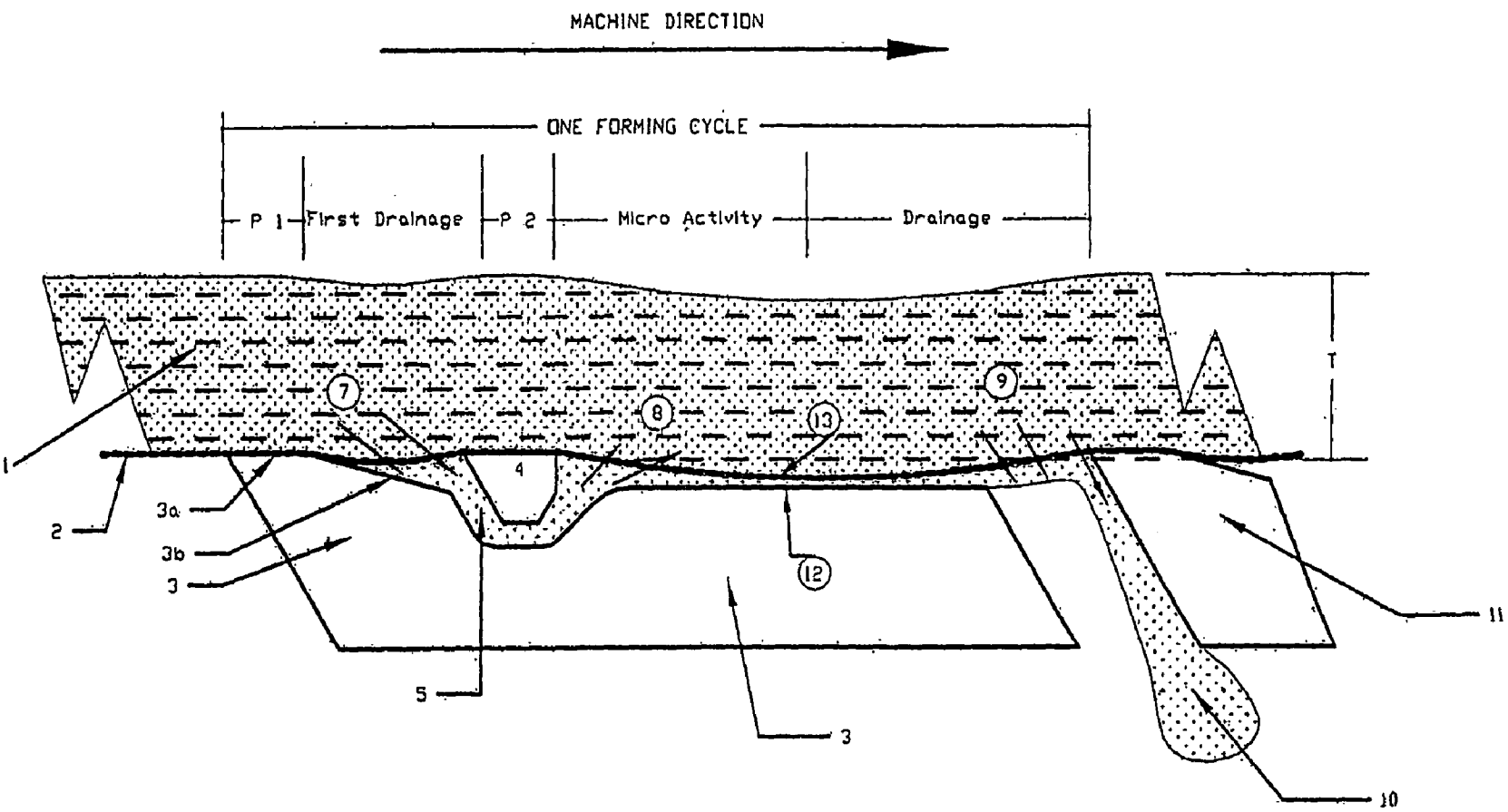
FIG. 9 Depicts a blade according to FIG. 8 with the support for blade 4 removed for clarity.
Figure 9A:
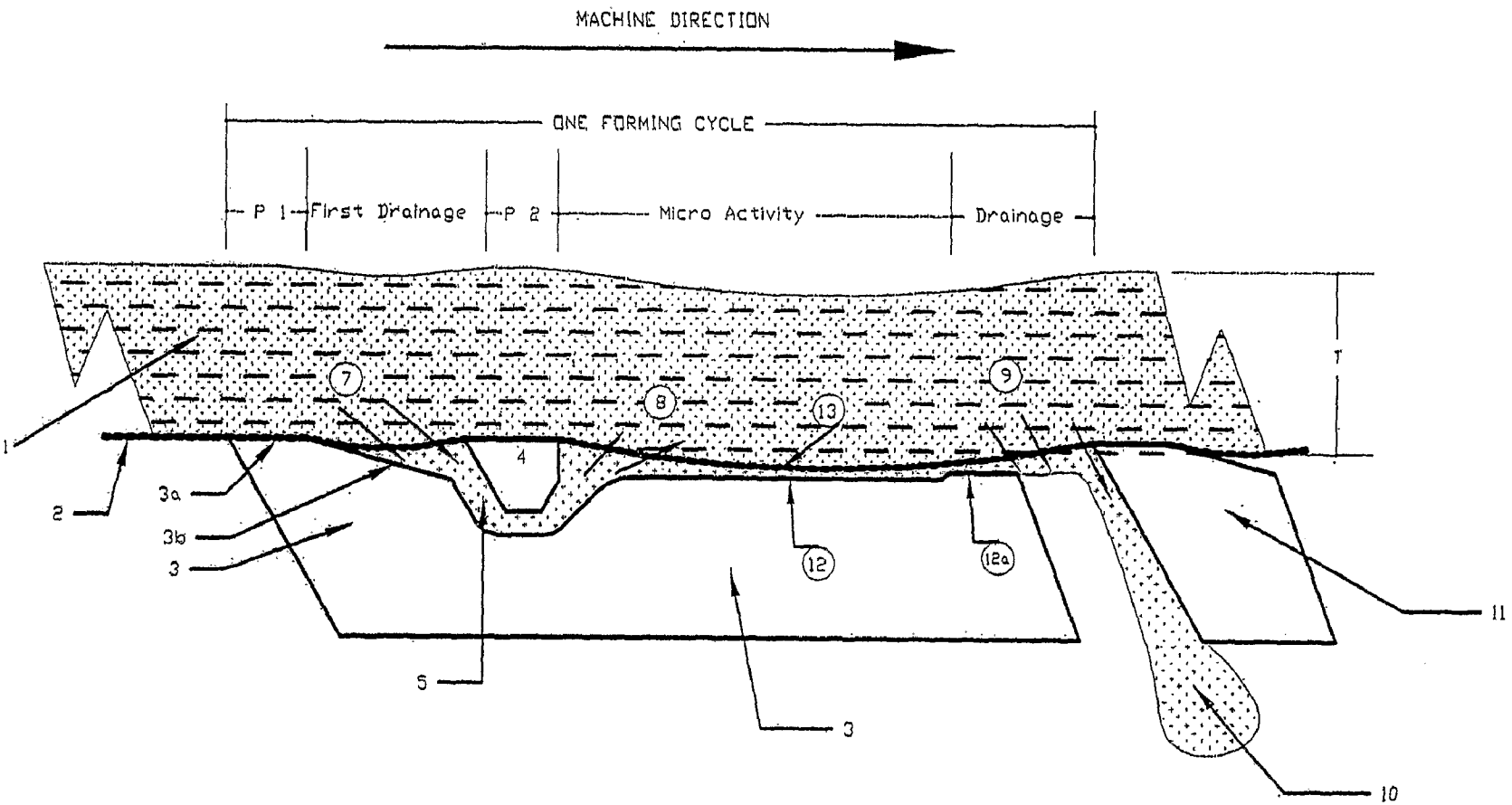
FIG. 9*a* Depicts a blade according to FIG. 9 with an offset section for control of drainage according to another aspect of the invention.
Figure 10:
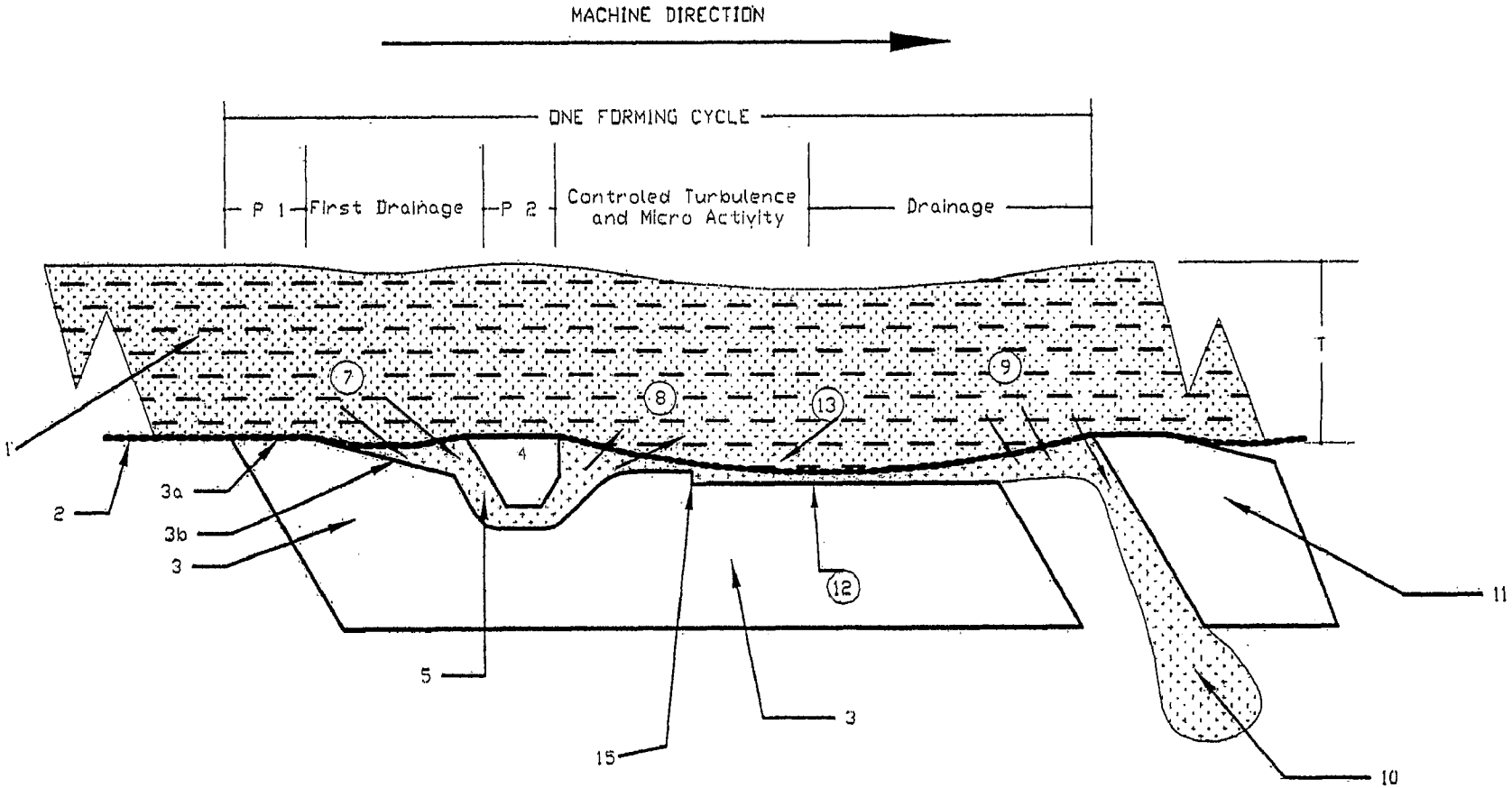
FIG. 10 Depicts a blade according to another aspect of the instant invention.
Figure 10A:
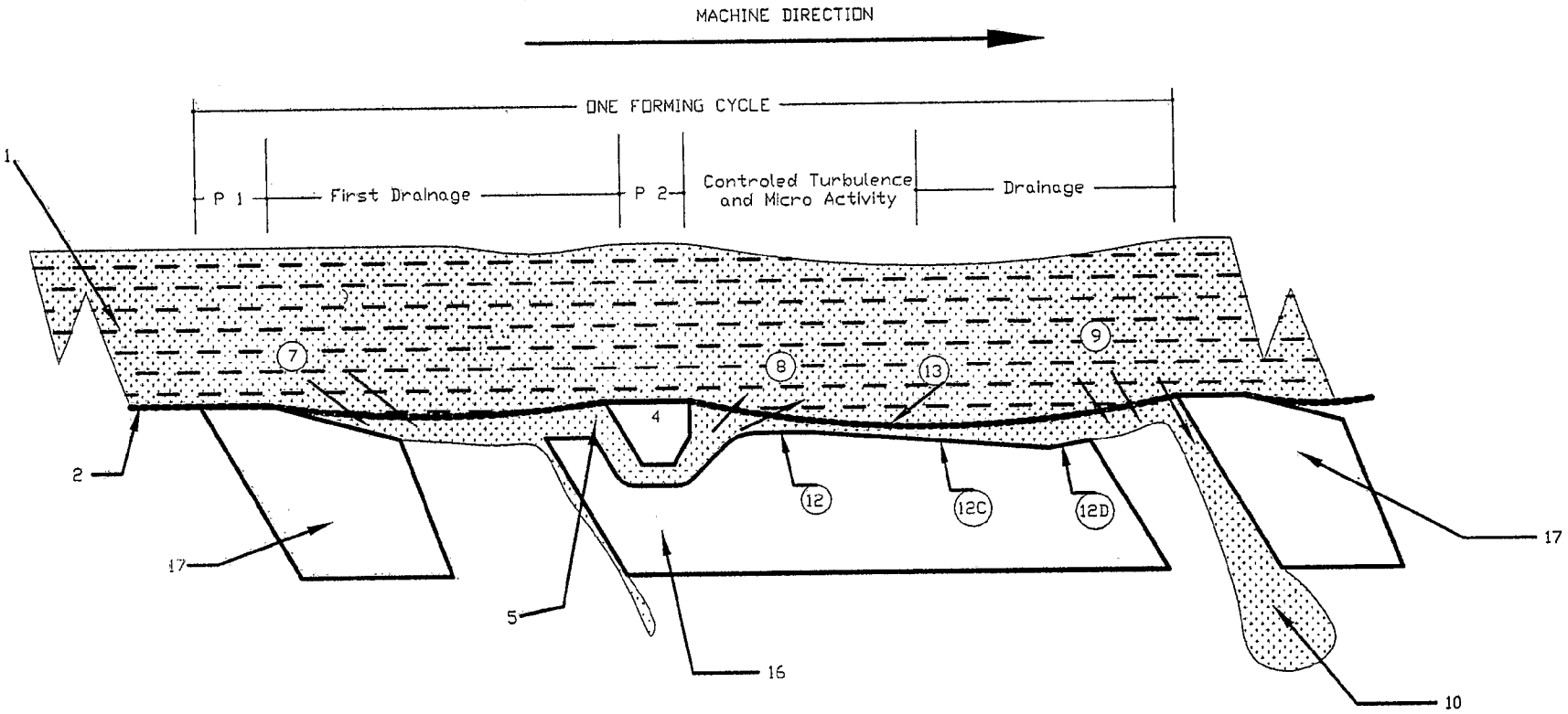
FIG. 10*a* Depicts a blade according to FIG. 10 with a multi-angled microactivity zone.
Figure 10B:
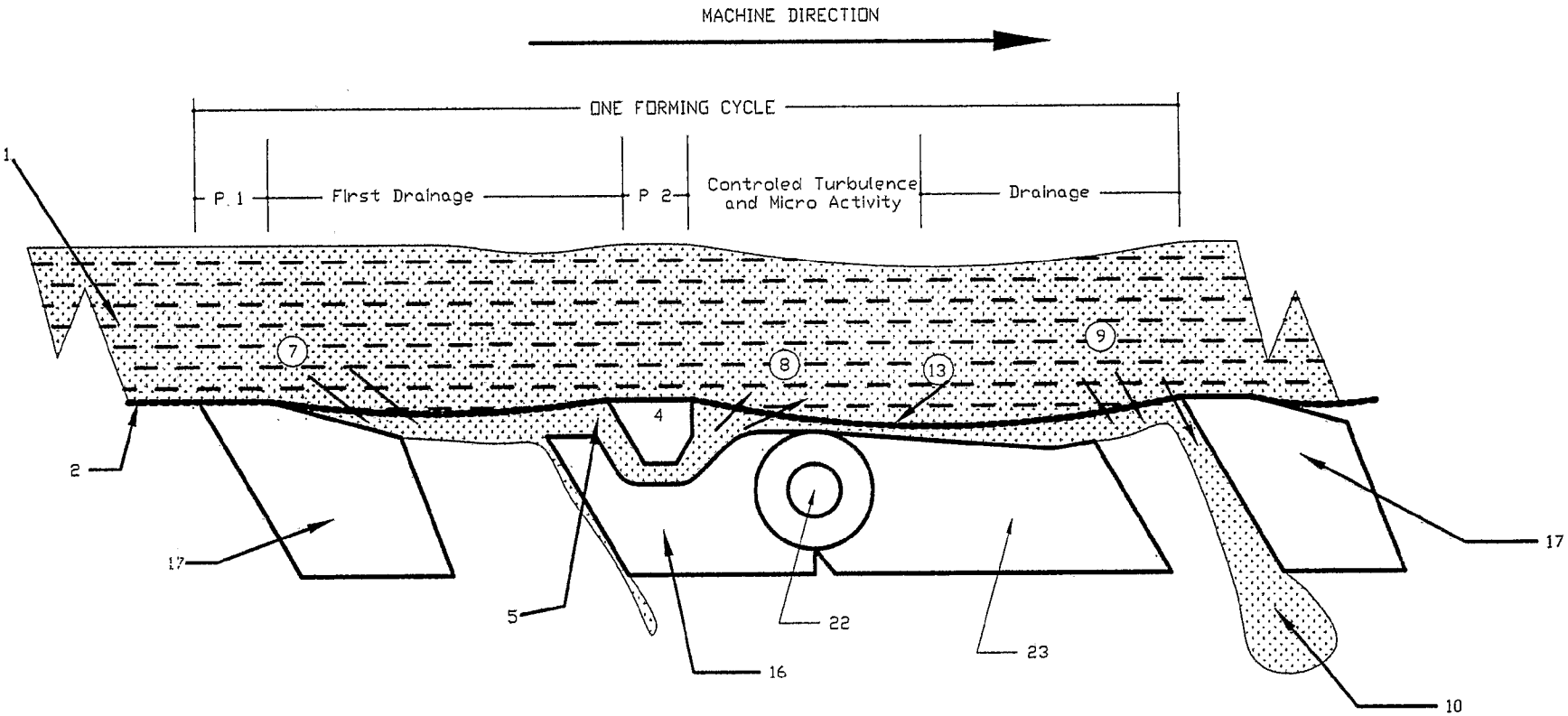
FIG. 10*b* Depicts a blade according to FIG. 10 with pivot point.

Next, there is a channel 5 which leads to a controlled turbulence zone 8 and then to a micro-activity zone 12. The micro-activity zone 12 may be flat as is shown in FIGS. 8 and 9, or may include a step 15 as shown in FIG. 10 to create controlled turbulence. Alternatively, the micro-activity zone 12 may have a divergent section 12*c* and a convergent section 12*d*, as shown in FIGS. 10*a* and 10*b*. The divergent section 12*c* has an angle $\alpha$ to horizontal and the convergent section 12*d* has an angle $\beta$ to the horizontal. The angles $\alpha$ and $\beta$ may be the same or preferably different to optimize the activity in the micro-activity zone. The micro-activity zone 12 may also include an offset plane 12*a* in order to retain water for activity improvement and control as show in FIG. 9*a*. In practice, the use of a flat, angled, or stepped micro-activity zone will depend on the machine speed, consistency of the mat and its basis weight.

Figure 15:
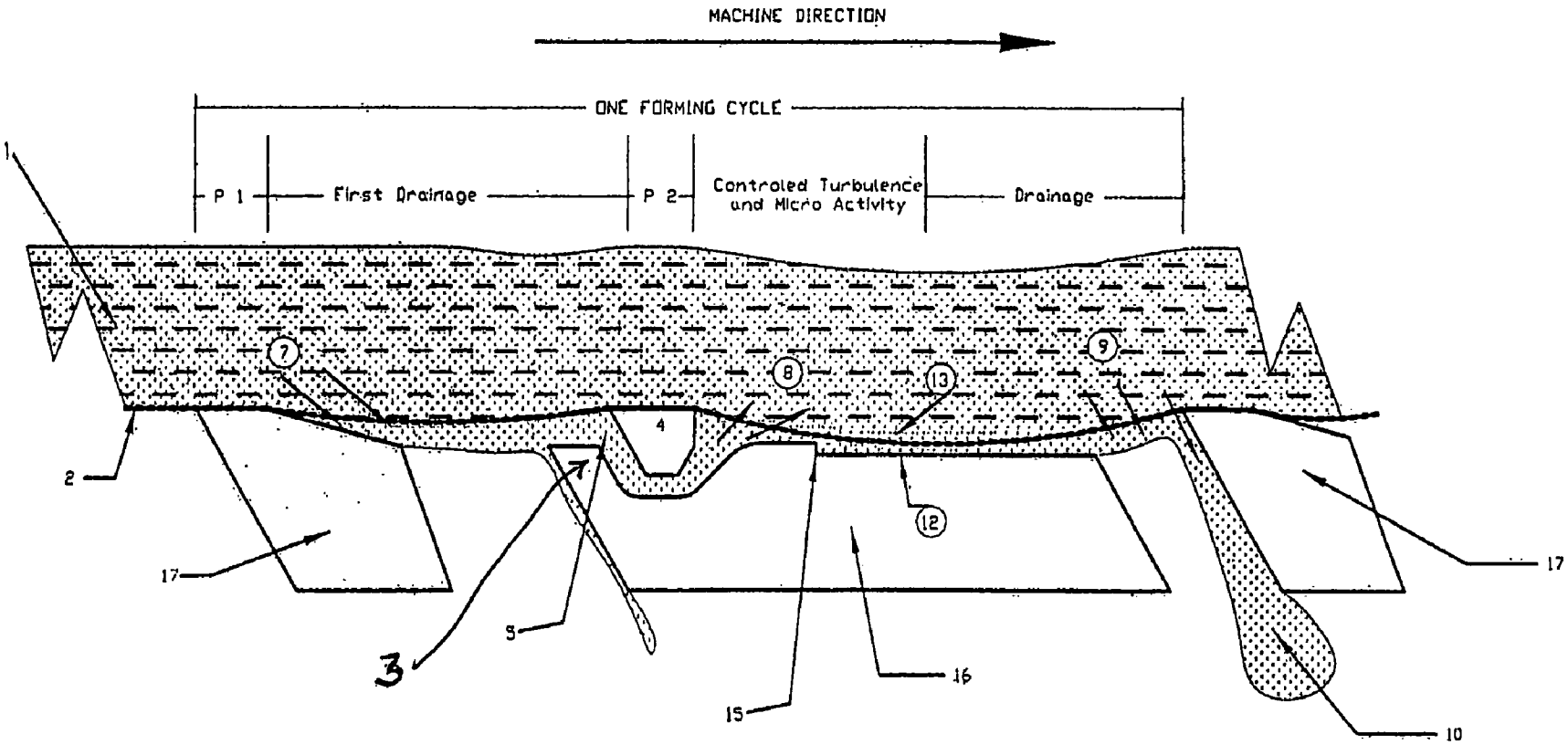
FIG. 15 Depicts a blade, according to another aspect of the instant invention.

Between the channel 5 and the micro-activity zone 12, there is a support blade 4. The support blade 4 helps to maintain the forming fabric 2 separated from the body 3 (or 3 and 16 as shown in FIG. 15, which will be described below). The support blade 4 also forms channel 5. The channel 5 allows water 7 to drain from the fiber slurry 1, through the fabric 2 and move towards the controlled turbulence zone 8 followed by the micro-activity zone 12. The support blade 4 is set in place by the spacers 14 and fixed by the bolts 6 and spacers 14. Bolts 6 are evenly distributed across the machine width in such a fashion that the support blade is not deflected and no disturbing streams are created. Following the micro-activity zone 12, where the forming fabric 2 comes closest to contacting the blade, water is drained into drain 10.

Figure 10C:
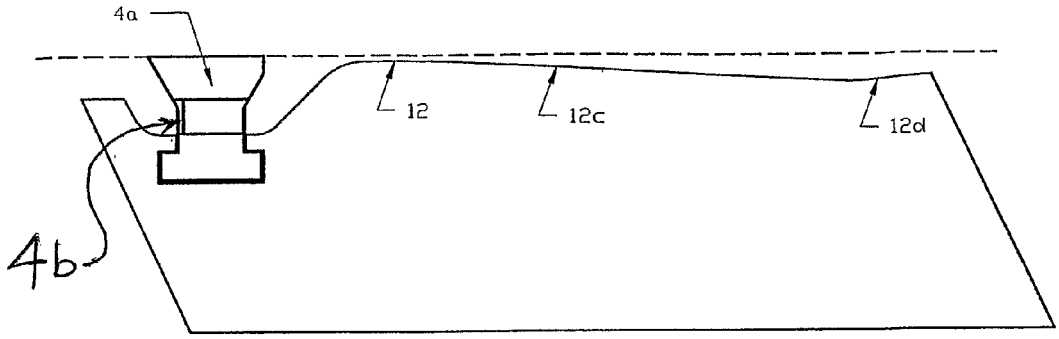
FIG. 10*c* Depicts a profile view of a blade and support as shown in FIG. 10.
Figure 10D:
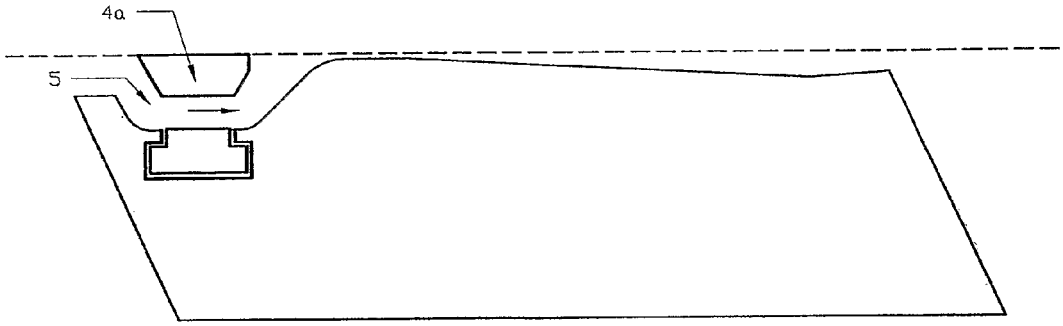
FIG. 10*d* Depicts a profile view of a blade as shown in FIG. 10 with an alternative support.
Figure 10E:
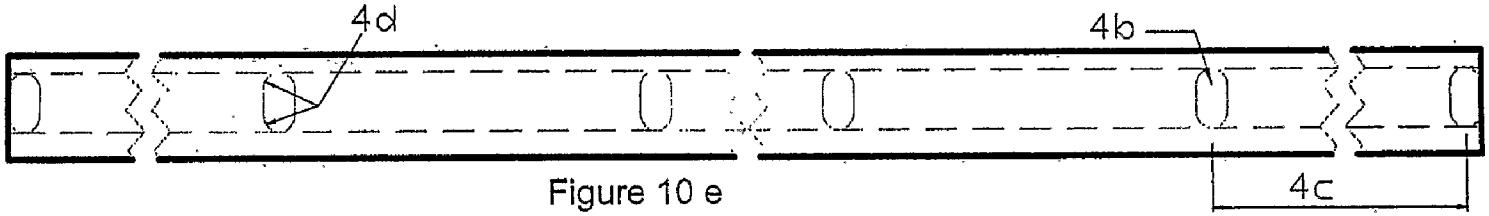
FIG. 10*e* Depicts a top view of a support blade usable with the blade shown in FIG. 10.
Figure 10F:
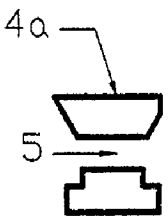
FIG. 10*f* Depicts a cross-sectional view of the support blade of FIG. 10*e* at a point where the support is open to allow flow of water through the support.
Figure 10G:
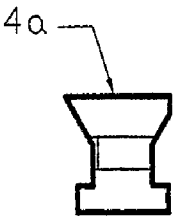
FIG. 10*g* Depicts a cross-sectional view of the support blade of FIG. 10*e* at a point where the support blade is closed by the support 4*d;*
Figure 10H:
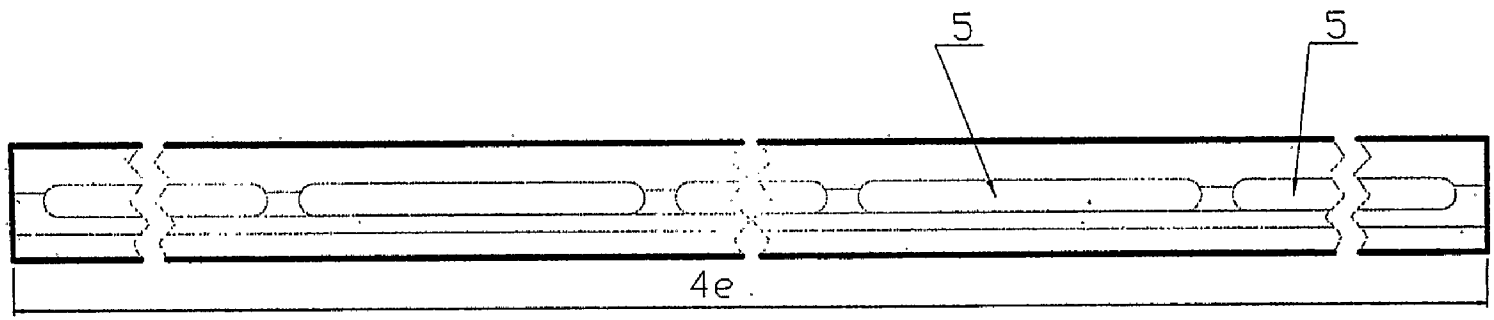
FIG. 10*h* Depicts a side view of the support blade of FIG. 10*e;*

Another aspect of the present invention is shown in FIGS. 10*c* and 10*d*, where a support blade 4*a* is shown in greater detail. FIGS. 10*c* and 10*d* are cross sectional view of a blade taken at different locations across the cross-machine direction of the blade. In FIG. 10*c*, the cross-section is taken along a portion of the support blade 4*a* where the spacer 4*b* is located. This in cross-section FIG. 10*c* shows a substantially solid support blade 4*a*. In contrast, FIG. 10*d* shows a cross-section taken along a different portion of the support blade 4*a* at a location where there is no spacer 4*b*, but rather a channel 5 through the support blade 4*a* for allowing the flow of water under the support blade 4*a*. Further details of this aspect of the invention can be seen with reference to FIGS. 10*e-h*, where top, cross-sectional and front views are shown, respectively. The spacers 4*b* preferably have a substantially rounded shape, as shown in FIG. 10*e*, to promote stable flow of water through the channel 5. The supports 4*b* are preferably evenly distributed across the entire width 4*e*. Such a configuration will ease in the installation or replacement of the support blade 4*a*, which is preferably made in one piece as shown in FIGS. 10*a-h*.

In practice another blade 11 may be installed immediately following the drain 10. A leading edge of the second blade 11 can be seen in FIG. 8. The number of blades necessary on the forming table is dependant on the thickness T of the fiber slurry 1, consistency of the stock, basis weight, retention and the machine speed.

Figure 11:
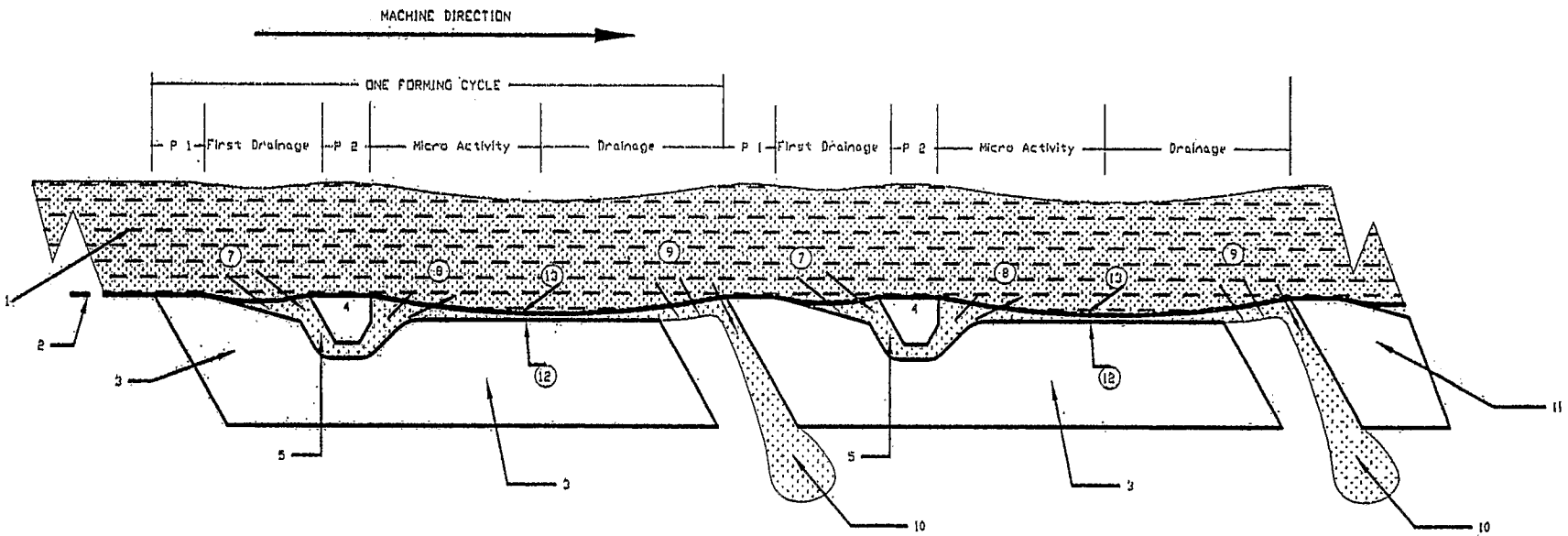
FIG. 11 Depicts a blade, according to another aspect of the instant invention.
Figure 12:
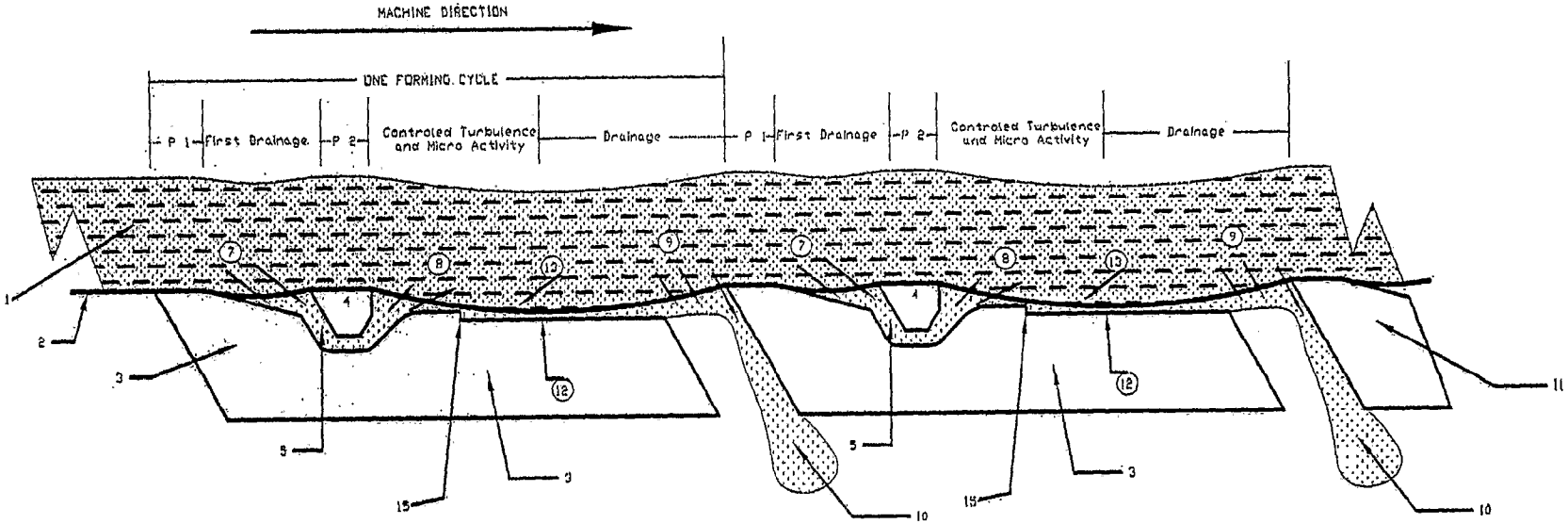
FIG. 12 Depicts a blade, according to another aspect of the instant invention.
Figure 13:
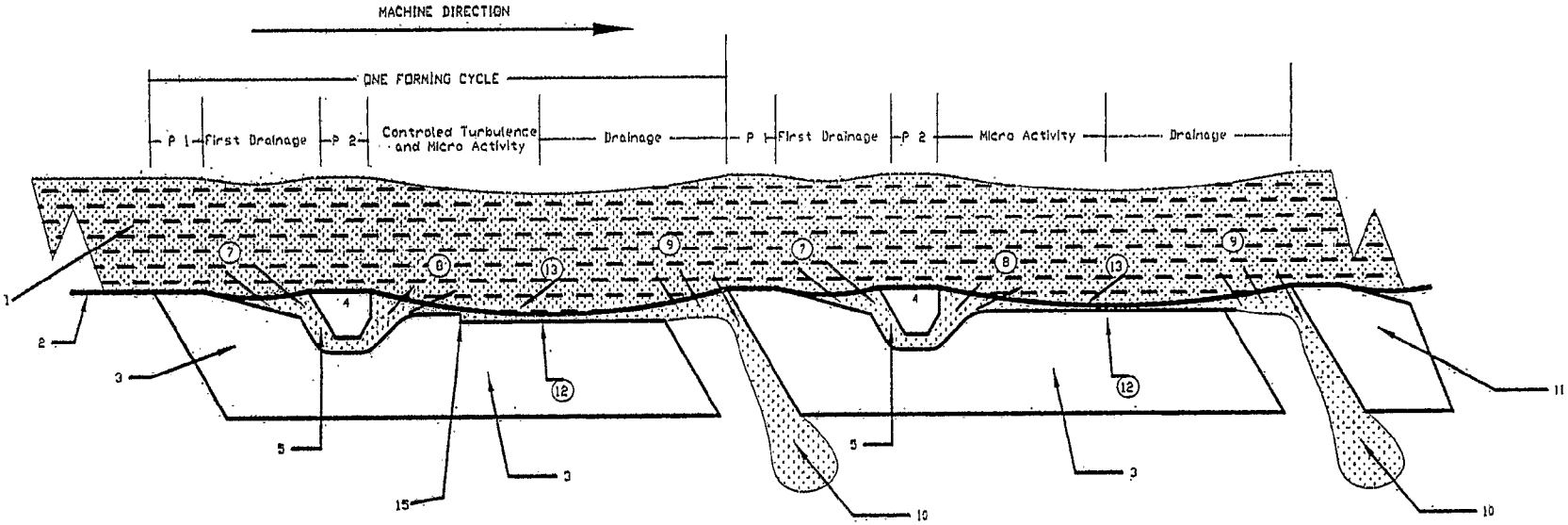
FIG. 13 Depicts a blade, according to another aspect of the instant invention.

A variety of configurations are possible using different aspects of the present invention including:

1. Blades with a flat surface 12, as shown in FIG. 11;
2. Blades with a step 15, as show in FIG. 12;
3. Alternating blades with a step 15 and a flat surface 12, as show in FIG. 13;
4. Blades with the lead in edge 16 that is actually removed from the rest of the blade and has a leading edge that angles away from the forming fabric in combination with a flat surface 12, as show in FIG. 14;
5. Blades with the lead in edge 16 that is actually removed from the rest of the blade and has a leading edge that angles away from the forming fabric in combination with a step 15, as shown in FIG. 15;
6. Blades with the lead in edge 16 removed from the rest of the blade and having a leading edge that angles away from the forming fabric with the activity zone formed of a converging and diverging sections 12*d*, 12*c* either with or without a pivot point 22 as shown in FIGS. 15*a* and 15*b*; or
7. A blade 24, 25 with an elongated micro-activity zone having multiple diverging and converging sections 12*c*, 12*d* either with or without a pivot point 22 as shown in FIGS. 15*c* and 15*d*.

Other arrangements of the blades according to certain aspects of the instant invention are also possible within the scope of the instant invention.

The blade as shown in FIGS. 8, 9, 9*a*, 10, 10*a* and 10*b*, performs one forming cycle where the necessary hydrodynamic processes to form the sheet of paper take place. At the leading edge 3*a*, a positive pulse P1 is created that produces shear effect. At the diverging surface 3*b*, the water 7 drains from the sheet or fiber slurry 1 due to increase in kinetic energy and reduction of potential energy. This is the second hydrodynamic process on the blade. Next, support blade 4 creates a second positive pulse P2 which is similar to P1. The drained water 7 follows in continuation through channel 5. Part of the drained water is then reintroduced to the sheet 2 in the micro activity zone 12 and the controlled turbulence zone 8. Draining continues with water exiting the blade through drain 10. Therefore, three hydrodynamic processes take place within one forming cycle in these sections of the blade.

FIG. 10*b* shows a pivot point 22 which allows the trailing portion of a blade 23 to be adjusted as necessary, according to the operating parameters of the device. FIG. 15*c* depicts a further aspect of the invention having multiple cycles of diverging and converging angled sections on a single long blade 25. These multiple cycles help preserve activity in the early part of the forming table. FIG. 15*d* depicts the same multi-cycle blade 24 formed with a pivot point 22.

Figure 25:
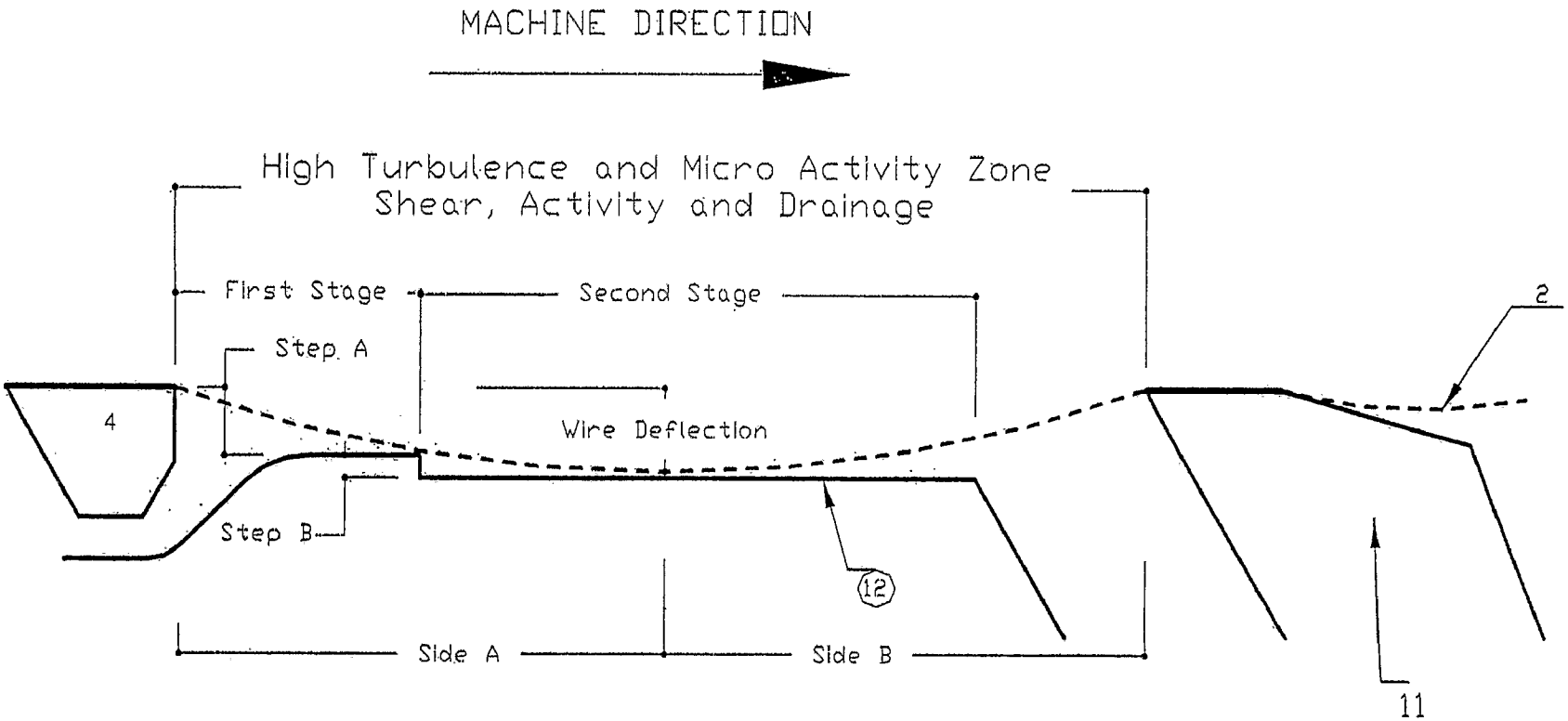
FIG. 25 Depicts a detailed view of blade geometry, according to at least one aspect of the present invention.

The thickness T of the slurry 1 does not affect the performance of the support blade 4 or the velocity of the machine. In practice, the dimensions of the steps A and B of the first stage, shown in FIG. 25, are sized according to the thickness of the slurry and the velocity of the machine. As such, because step A can be adjusted by adjusting support blade 4, the properties of the device can be optimized for a particular stock thickness and machine speed.

As a result of the hydrodynamic process performed by the blade, and the reintroduction of water in the early part of the blade, the following improvements may be obtained by the present invention:

I. There is no filtration process in the early part of the blade;
II. The power necessary to drive the wire is reduced because there is no drag created by the wire acting on the blade, as the blade is supported by the water along its length;
III There is no dirt accumulation on the blade because there is continuous flow of water;
IV. The fibers on the wire are redistributed and activated with the same water;
V. Fines retention is increased and evenly distributed across the thickness of the sheet;
VI. Formation is improved;
VII. Squareness of the sheet is controlled as is necessary;
VIII. Drainage is controlled, and the filtration process may be eliminated; and
IX. Physical properties of the paper are improved or controlled as are necessary.

Figure 14:
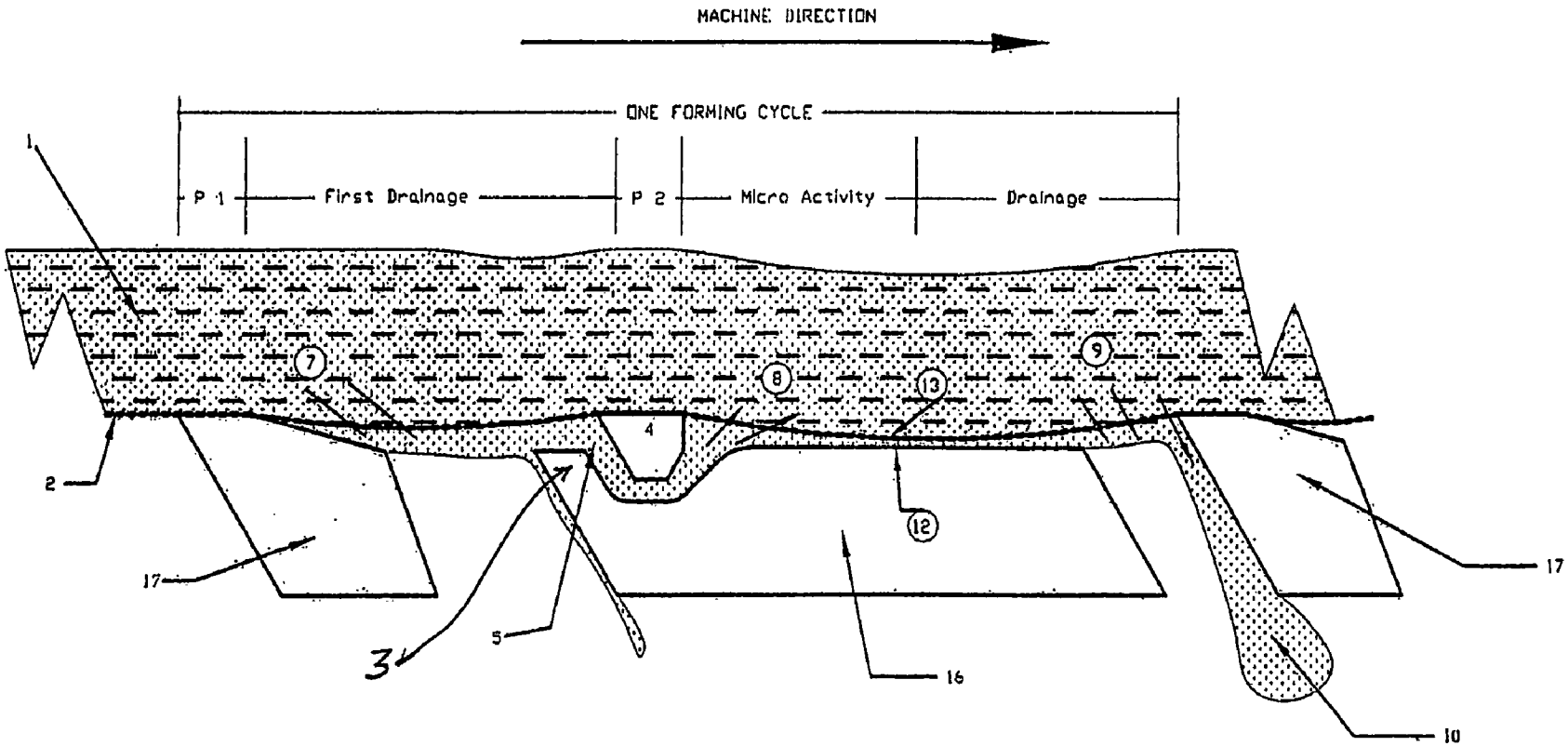
FIG. 14 Depicts a blade, according to another aspect of the instant invention.
Figure 15A:
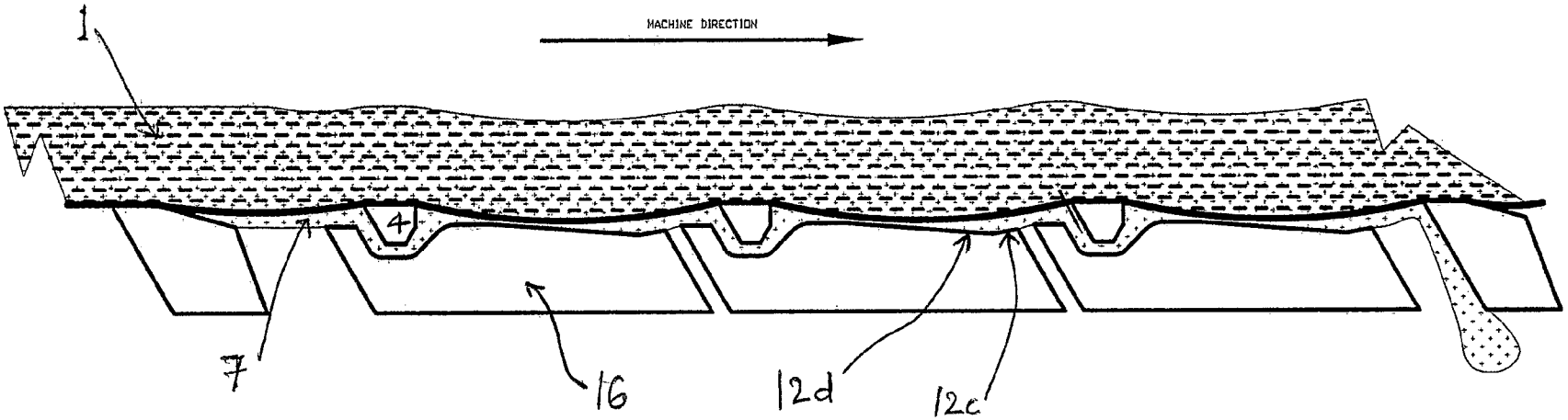
FIG. 15*a* Depicts a blade as shown in FIG. 14 having multiple main body portions between foils.
Figure 15B:
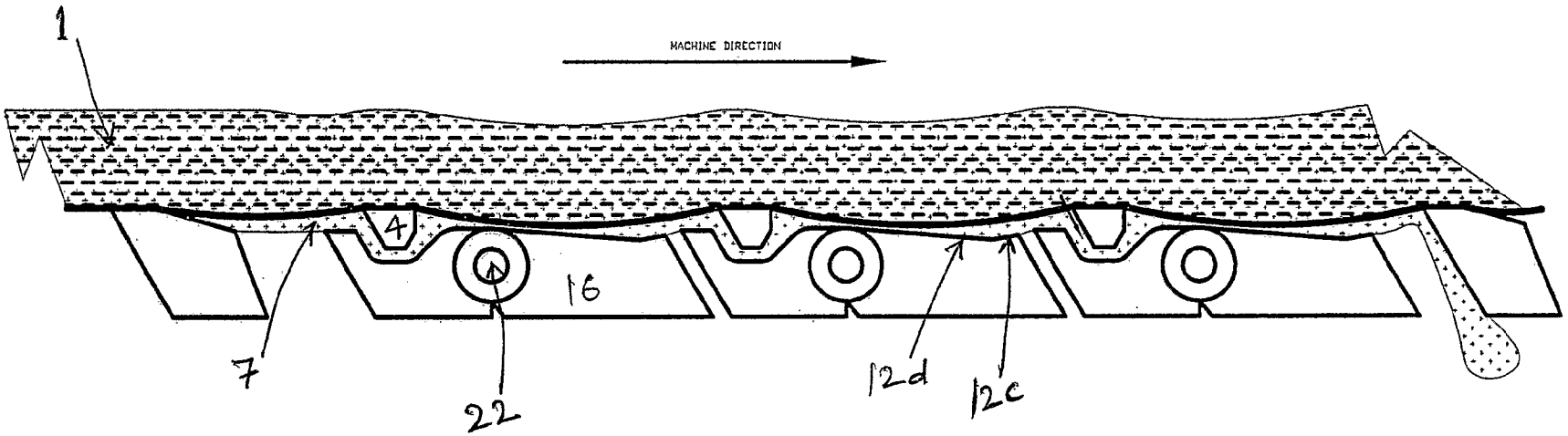
FIG. 15*b* Depicts a blade as shown in FIG. 15*a* having pivot points on the main bodies.
Figure 15C:
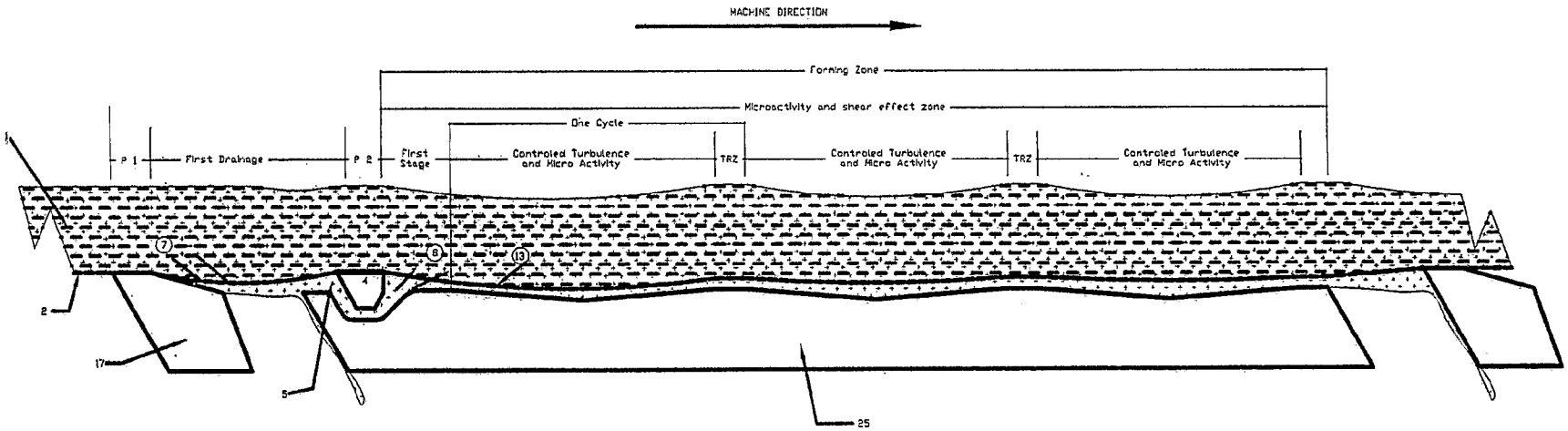
FIG. 15*c* Depicts a blade as shown in FIG. 14, having elongated and multiple activity zones.
Figure 15D:
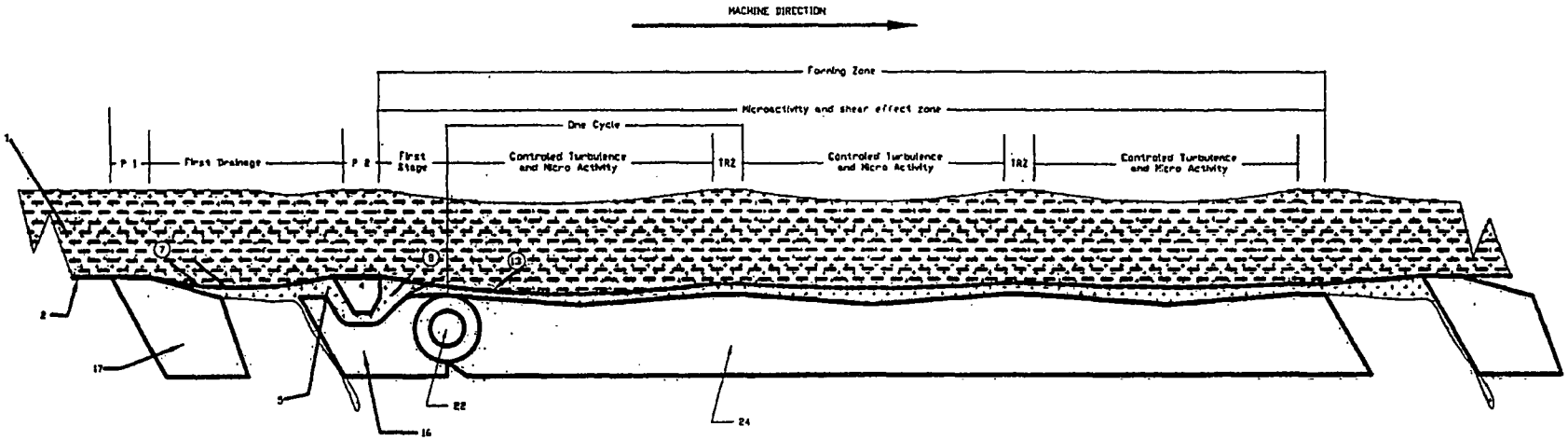
FIG. 15*d* Depicts a blade as shown in FIG. 15*c* having pivot points.

FIGS. 14 and 15 show a further aspect of the present invention, where the leading edge 3 is separated from the main body 16 of the blade. This configuration is useful in machines when either drainage has been done in previous elements without water removal, or there is limited space on the forming table, allowing greater, yet controlled amounts of water to be removed from the fibrous slurry 1.

Figure 16:
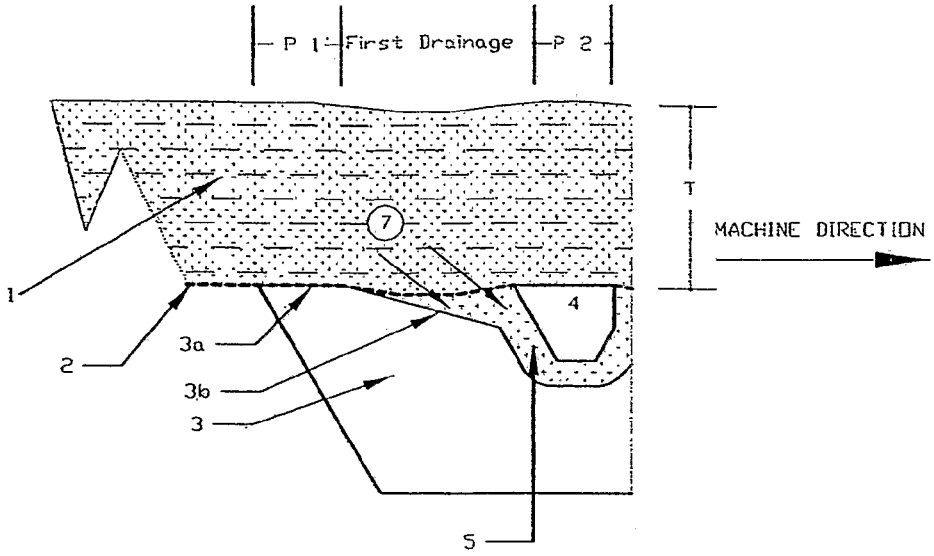
FIG. 16 Depicts the hydraulic performance of a blade, according to one aspect of the present invention.

FIGS. 16, 17, 18, 19, 20, and 20*a* show the hydraulic performance of blades according to certain aspects of the instant invention. In FIG. 16, in section 3*a* a positive pulse P1 is created that produces shear effect. The diverging section 3*b* drains water 7 due to increase in kinetic energy and reduction of potential energy. This is the second hydrodynamic process on the blade. The support blade 4 creates a second positive pulse P2 which is similar to P1. The drained water 7 follows continuously through channel 5.

Figure 17:
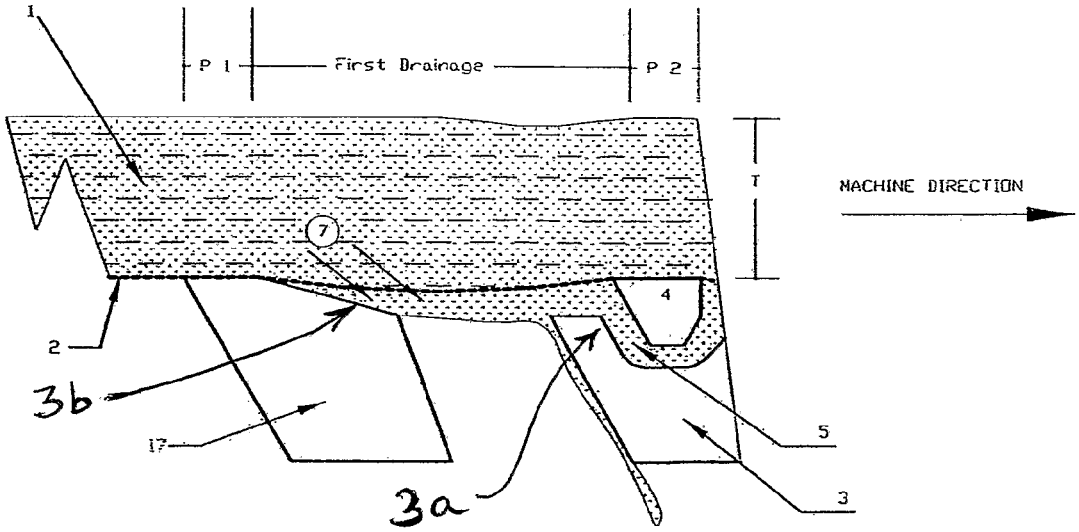
FIG. 17 Depicts the hydraulic performance of a blade, according to one aspect of the present invention.

In FIG. 17, the water 7 is drained by a foil 17 which has the leading edge 3*a* and the diverging section 3*b*, located on a separate portion of the blade. Again, the leading edge 3*a* of the foil 17 creates a positive pulse P1 and produces a shear effect. The diverging section 3*b* drains water 7 from the fibrous slurry to promote activity, which flows continuously through channel 5. Again the support blade 4 creates a pulse P2 (Alternating positive pulses that creates shear effect on cross machine direction) that is similar to P1.

Figure 18:
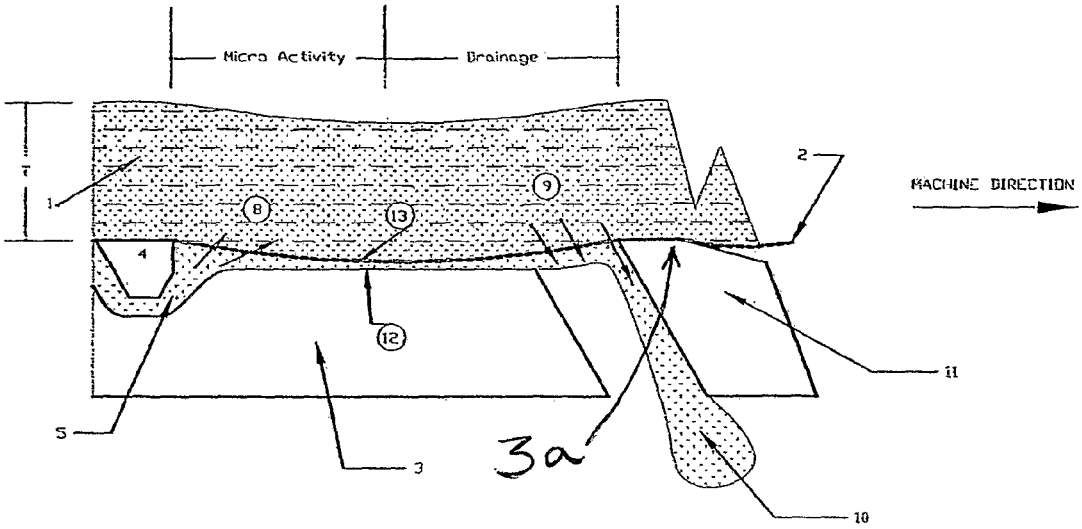
FIG. 18 Depicts the hydraulic performance of a blade, according to one aspect of the present invention.
Figure 19:
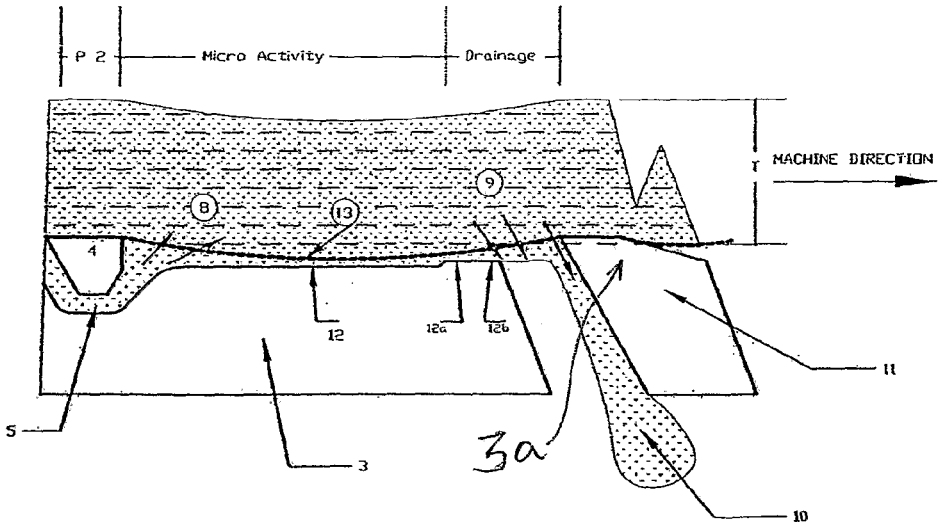
FIG. 19 Depicts the hydraulic performance of a blade, according to one aspect of the present invention.
Figure 20:
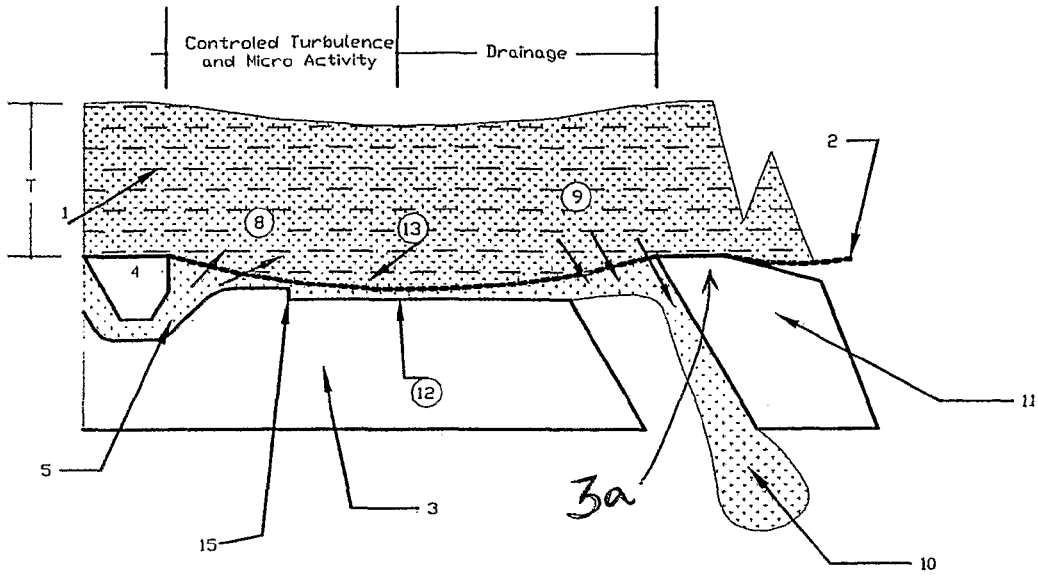
FIG. 20 Depicts the hydraulic performance of a blade, according to one aspect of the present invention.

FIGS. 18, 19 20, and 20*a*, show the hydrodynamic effects of: a flat micro-activity zone in FIG. 18; a micro-activity zone with an offset plane in FIG. 19; and a stepped micro-activity zone in FIG. 20. In each of these figures, part of the drained water 7 is reintroduced to the sheet 1 in the micro activity zone 12 and/or in the controlled turbulence zone 8. Continuation drainage also takes place. As discussed above, shear is created at the leading edge 3*a* and the support blade 4 produces pulses P1 and P2. When water 7 is reintroduced in section 8, the fibers are redistributed, thereby creating activity in section 8. Where necessary, fine shear may be created with the use of a step 15, as shown in FIG. 20. To increase the micro-activity in the micro-activity zone 12, an offset plane 12*a* may be employed to retain additional water as necessary. The micro-activity zone 12 is comprised of offset sections 12*a* and 12*b*. These offset sections may be flat or angled. The final design of the offset sections 12*a* and 12*b* depends on the thickness of the slurry and the machine speed. Typically, drainage is controlled in late part of sections 12, 12*a* and 12*b*.

Figure 20A:
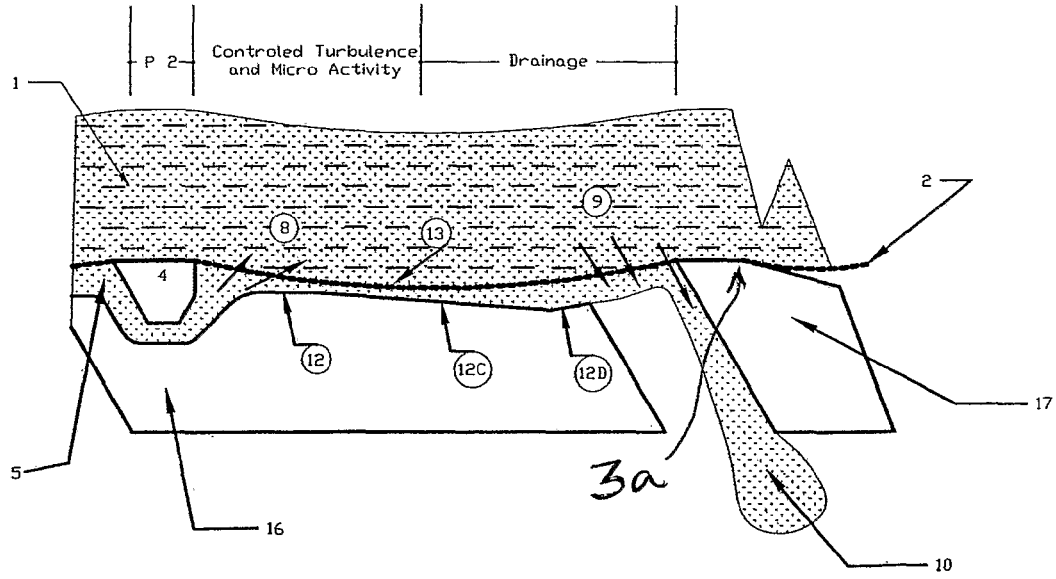
FIG. 20*a* Depicts the hydraulic performance of a blade, according to another aspect of the present invention.

FIG. 20*a* shows an arrangement capable of operation without additional vacuum. This is possible by use of the diverging section 12*c* and the converging section 12*d*, discussed above. In use, the diverging section 12*d* creates a vacuum by the angle of the divergence causing a loss in potential energy. This created vacuum then draws water from the stock. A portion of the water is then reintroduced by the converging section 12*d* and creates activity in the stock. However, a larger portion of the water is drained by drain 10.

Figure 21:
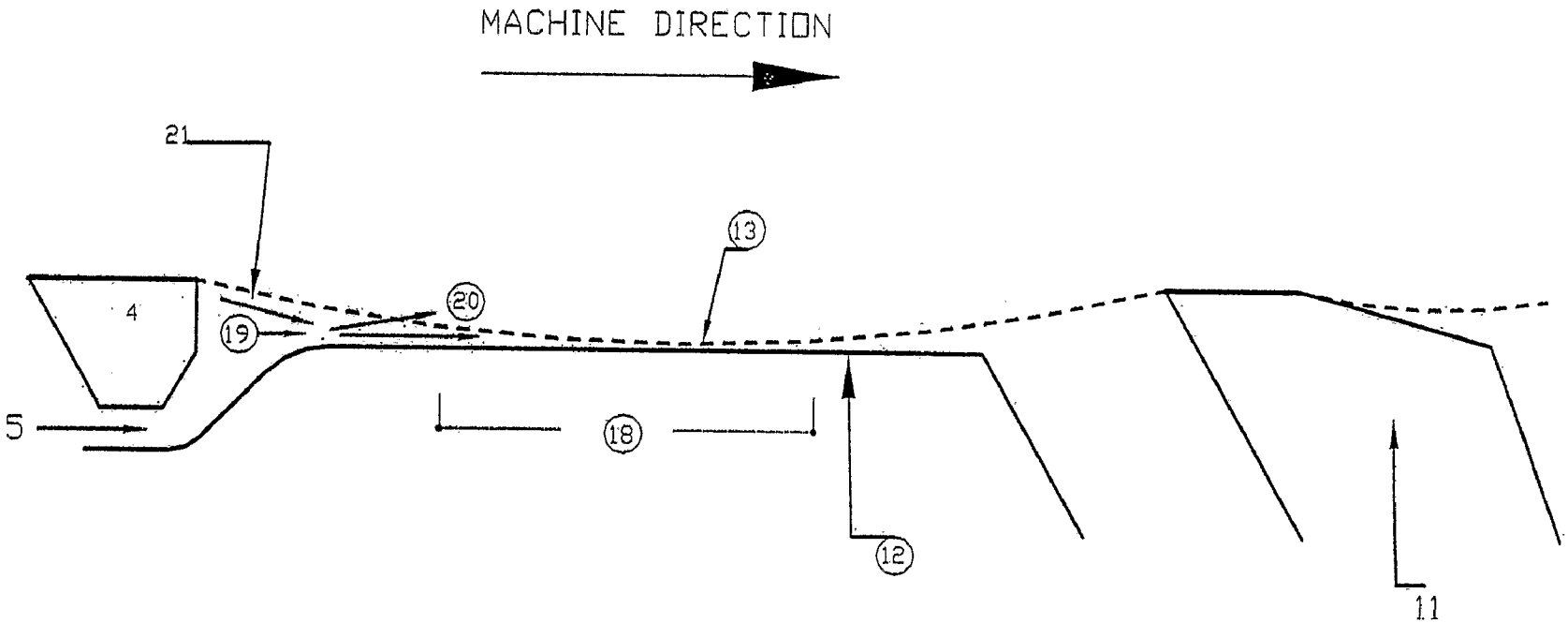
FIG. 21 Depicts water flow in a blade, according to one aspect of the present invention.

In FIG. 21 a further aspect of the instant invention is depicted. The water 7 that flows through channel 5 forms stream lines 19 in section 21. As long as the hydraulic cross section of the flow path of the water 7 is being continuously reduced, the water 7 is forced into and is reintroduced through the forming wire 13 and into the fiber slurry 1. The force of the reintroduced water 7 may deflect the forming fabric 13. However, this is countered, at least to some degree, by the vacuum generated by the increase in the kinetic energy. In section 18, fiber activity and shear effect are generated and as a consequence, the fiber mat formation is improved. Unlike some of the known methods of sheet production described above, the forming fabric 12 does not contact the surface of the micro-activity zone 12 because of continuous water flow through channel 5. As a result, the sheer and fiber activity in the sheet 1 are not interrupted.

Figure 22:
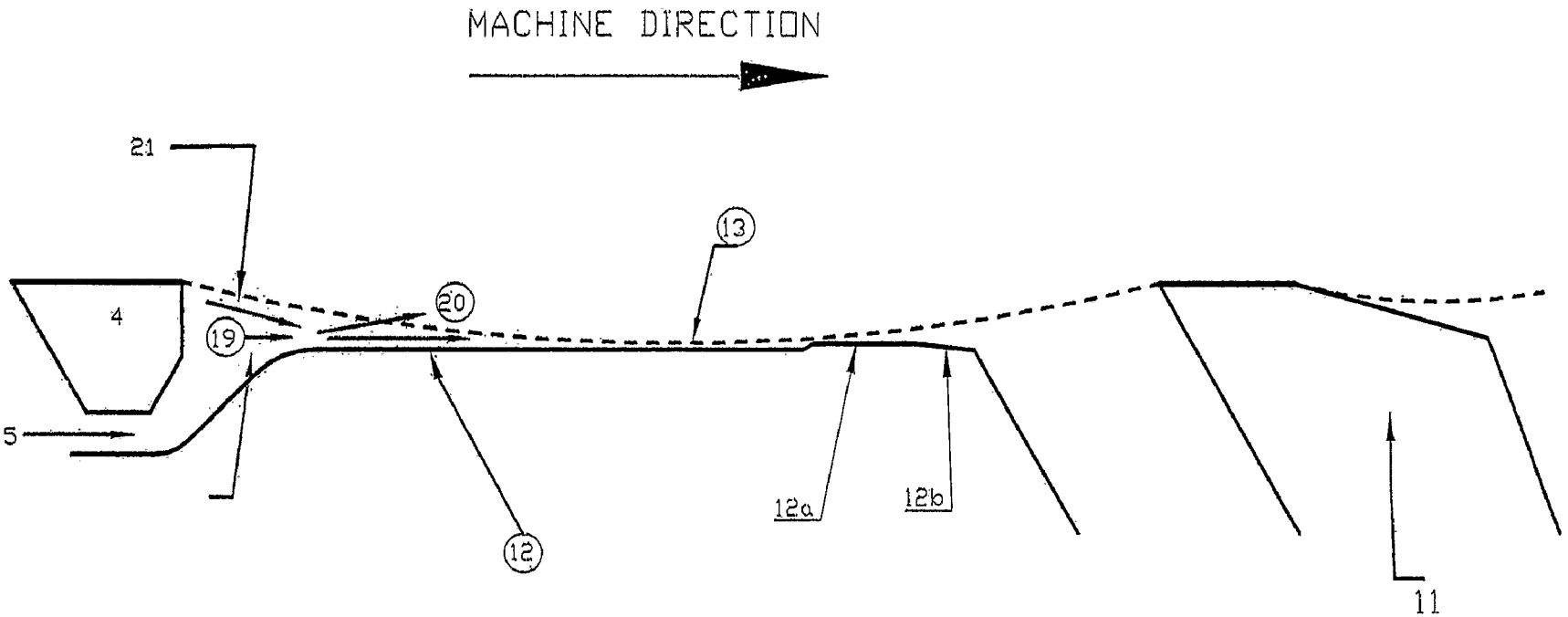
FIG. 22 Depicts water flow in a blade, according to one aspect of the present invention.

In FIG. 22, in an attempt to retain a certain portion of the water 7 for the micro-activity zone 12, there is an offset plane that includes portions 12*a* and 12*b*. Portion 12*b* may be designed at an angle that may be between 0.1 to 10 degree in order to control drainage. The preferred range for the angle of portion 12*b* is between 1 and 3 degrees.

Figure 23:
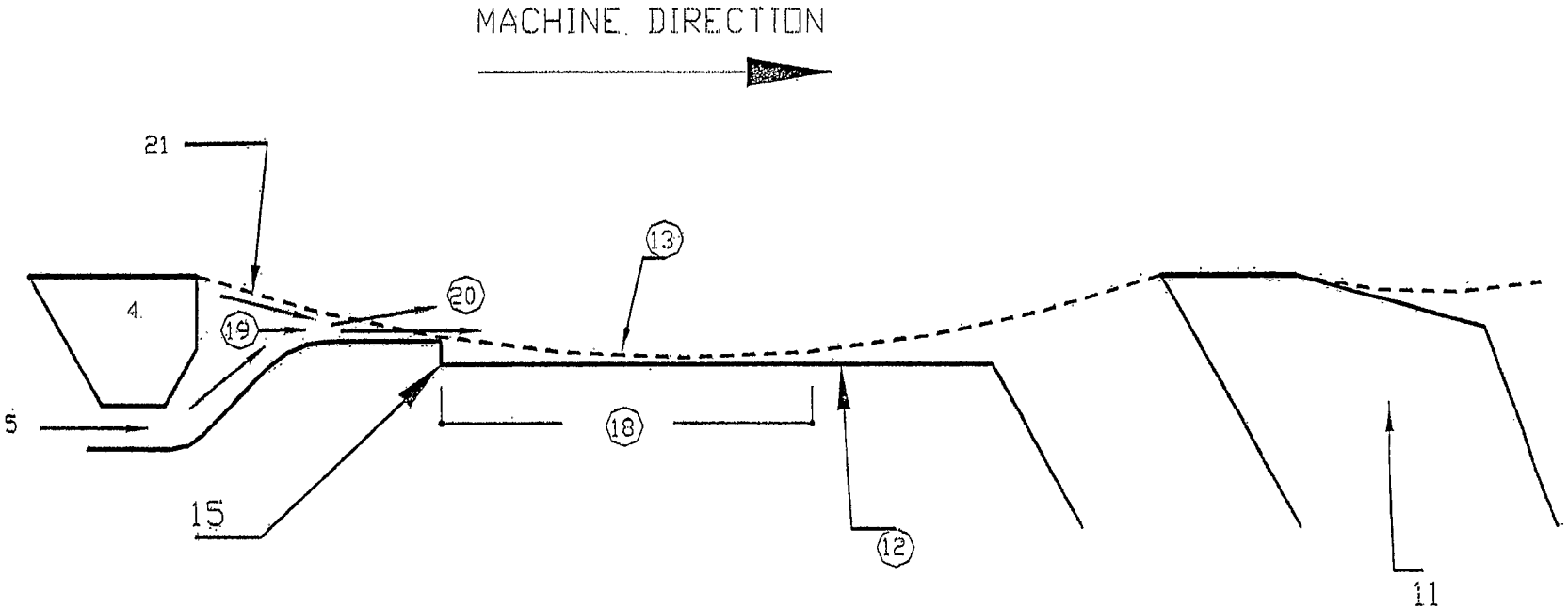
FIG. 23 Depicts water flow in a blade, according to one aspect of the present invention.

FIG. 23 depicts a blade that uses a step 15 to produce high levels of turbulence. The actual dimensions of the step 15 are dependant on the thickness of the slurry, consistency of the slurry and the machine speed.

Figure 24:
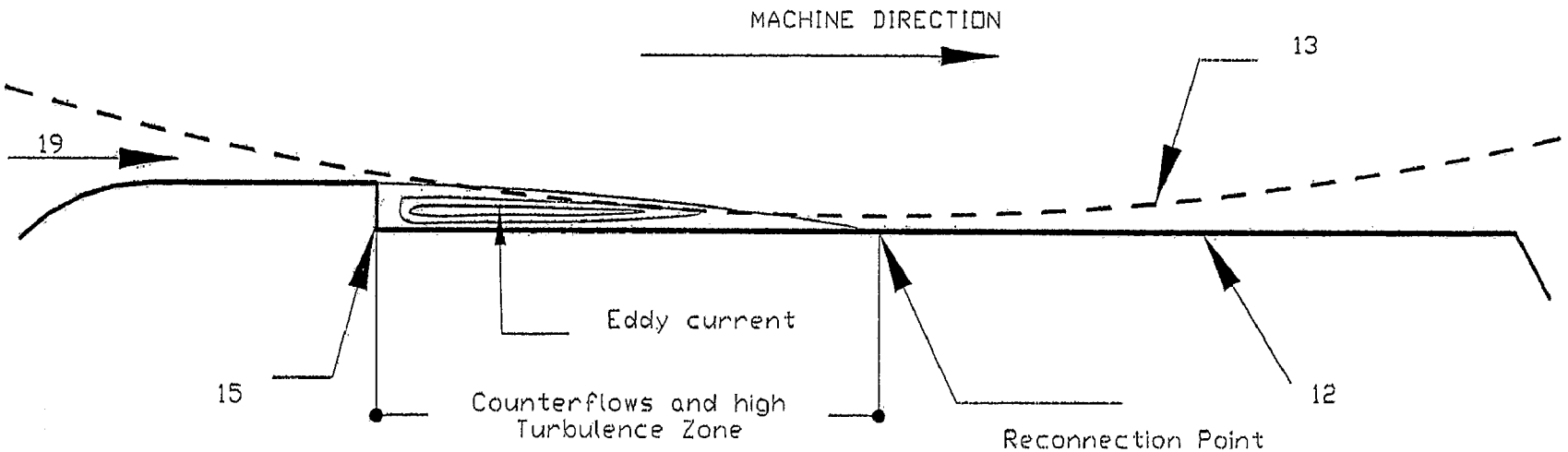
FIG. 24 Depicts water flow in a blade, according to one aspect of the present invention.

FIG. 24 depicts the stream lines 19 of water flow that occur as the forming fabric passes over the step 15. As can be seen, eddy currents are formed in the machine direction and are created along the entire machine width. The eddy currents will generally be in a clockwise rotation, when observing a device having a machine direction as shown in FIG. 24. The flow of water 7 becomes stable at the reconnection point. The dimension of the counter flows zone will depend on the machine speed, step size and the amount of water on the step. The eddy currents create high levels of turbulence and differential velocities between the fiber slurry and the eddy currents. This action breaks the flocks of fibers, thereby redistributing the fibers and improving paper formation.

Another aspect of the instant invention is directed to blade geometry. In FIG. 25, the area between the exit side of support blade 4 and the lead in edge of the following blade 11 is where the shear, activity and drainage occur (the three hydrodynamic processes needed to form the paper sheet). Side A of the blade is where hydrodynamic shear and activity are developed, and drainage occurs at side B of the blade. The first stage is from the exit side of support blade 4 to the edge of the step 15. Step A is sized according to the amount of water coming from previous elements and the water drained at this stage. In the first stage, water is reintroduce to the fiber slurry 1 and high shear effect is developed. From the beginning of the second stage up to the maximum point of wire deflection, high activity is developed due to the eddy currents at the step and the instantaneous differential velocities between the water 7 and the forming fabric 13. Side A is the higher pressure side of the blade and thus water will always flow in direction towards side B of the blade, ultimately resulting in drainage.

Figure 26:
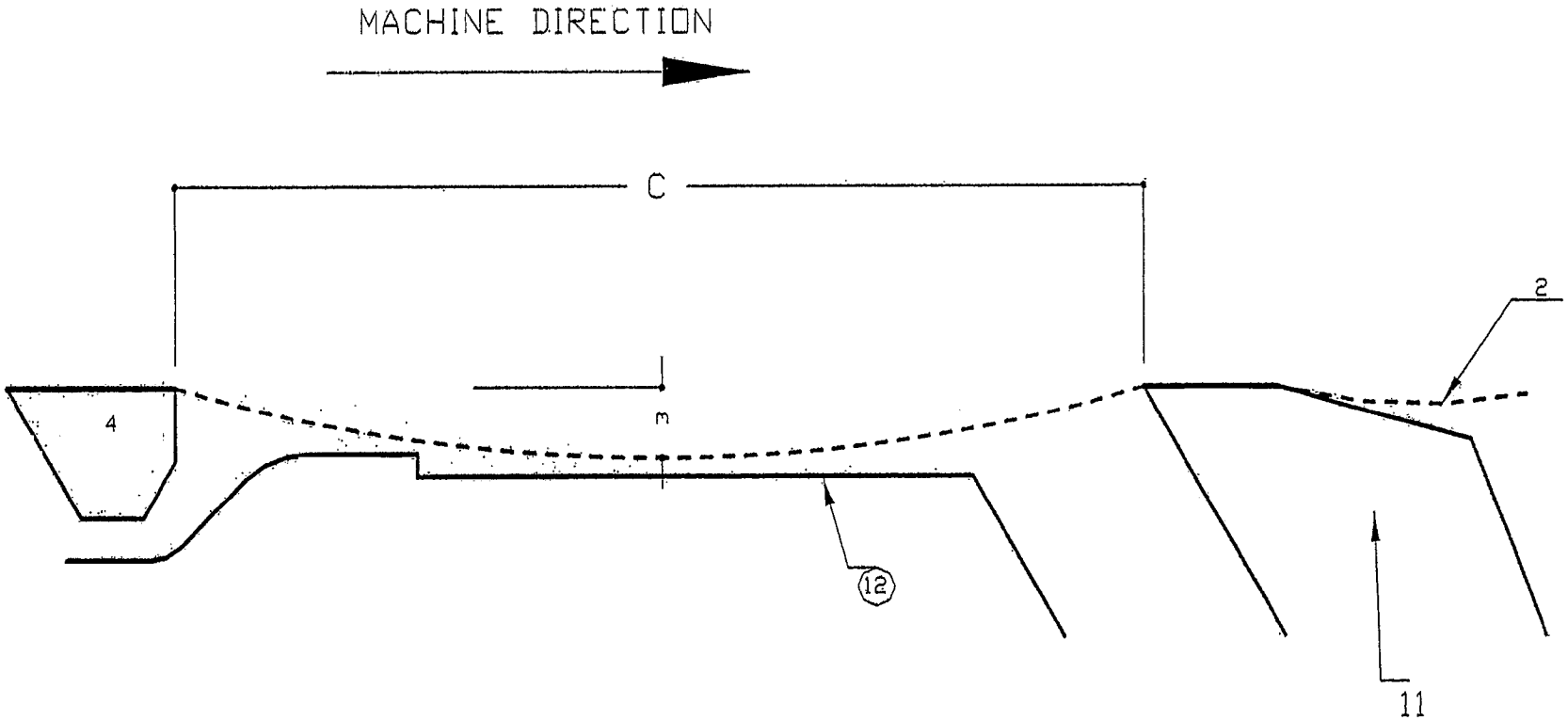
FIG. 26 Depicts the blade geometry bases for calculating pressure, according to one aspect of the present invention.

FIG. 26 provides a model for determining the dynamic pressure developed on the forming fabric, which can be calculated by the following equation:

$$\frac{K}{4.\cdot m^2 + c^2}\cdot m\cdot Vm^2$$

where 'm' is deflection of the wire in inches, 'c' is the span of the wire in inches, 'Vm' is the machine speed in feet per minute, and 'K' is a constant, of value 0.82864451984491991898e-3.

The dynamic pressure developed on the forming fabric is proportional to the gravitational or centrifugal force experienced by the forming fabric, which is commonly referred to as the 'g-force', and usually lies in the range of 1 to 10, however, values between 3 and 5 are preferable.

Those of skill in the art will recognize that other values for 'K' can be used to undertake this calculation without departing from the scope of the present invention, however, the value provided above has been determined to be preferable.

Figure 27:
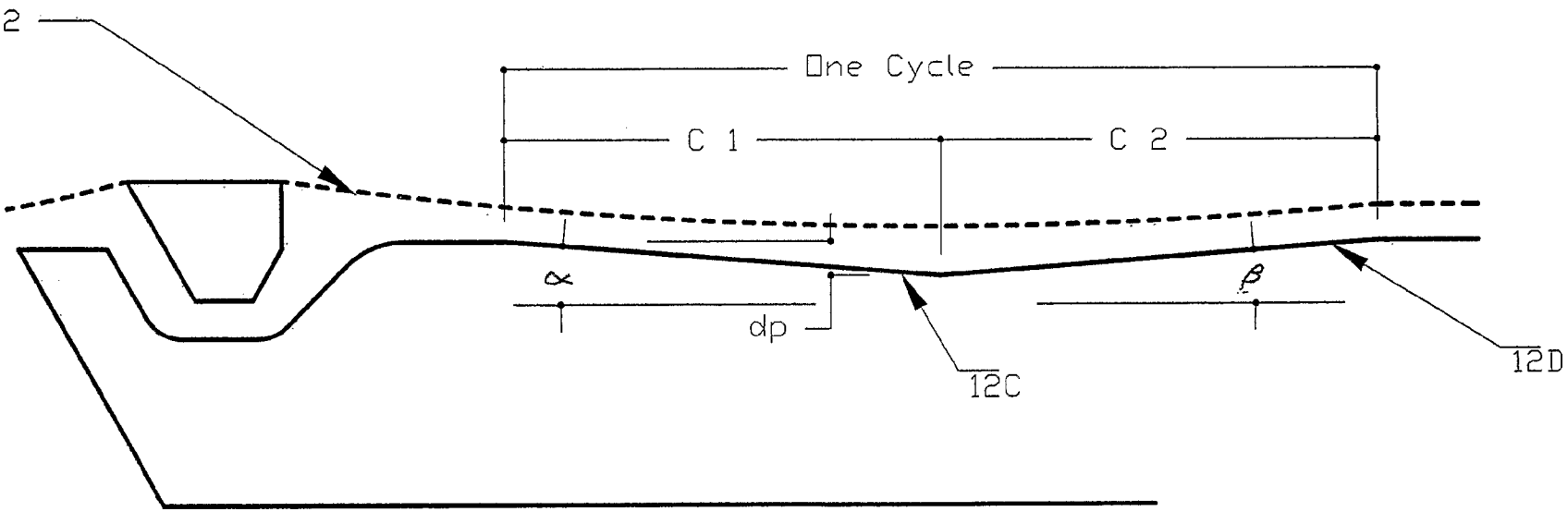
FIG. 27 Depicts the blade geometry bases for calculating pressure, according to another aspect of the present invention.

FIG. 27 shows a close-up view of a blade having converging and diverging sections 12*c* and 12*d*, respectively. Though shown herein as having the same length C1 and C2, these lengths may be optimized as necessary for the production process. Further, the angles, $\alpha$ and $\beta$, can be optimized for creation of vacuum and reintroduction of water into the stock respectively.

Figure 28:
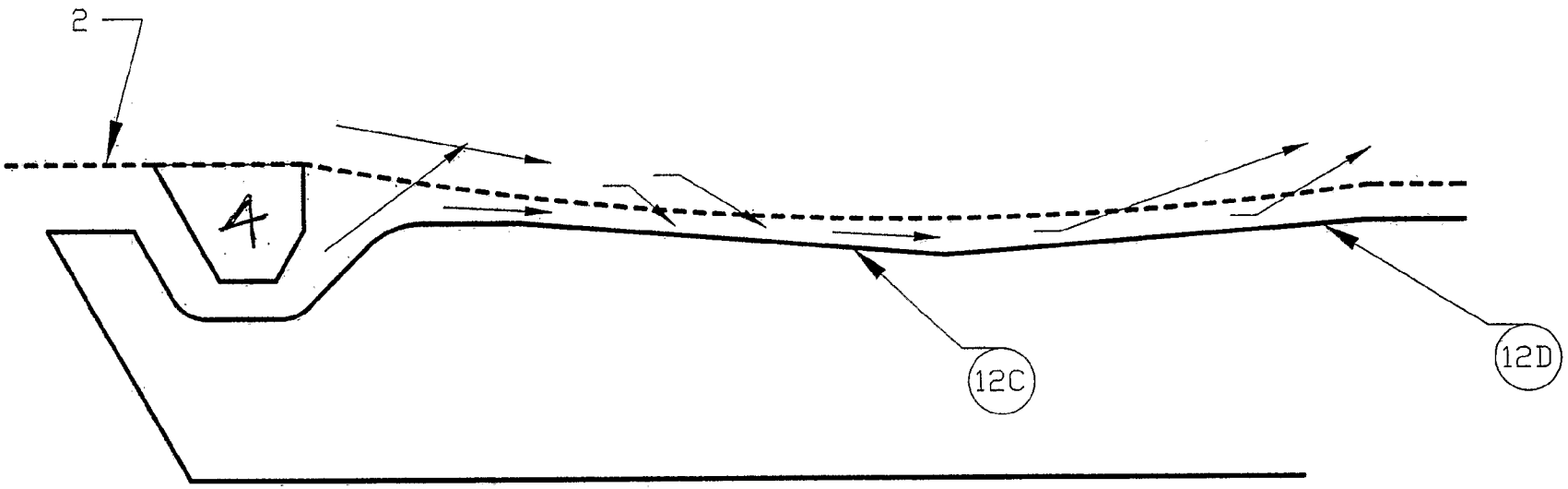
FIG. 28 Depicts water flow in a blade, according to one aspect of the present invention.

Finally, FIG. 28 generally shows the flow pattern of water entrained in the stock as the wire passes 2 over the support blade 4 and through the diverging and converging sections 12*c* and 12*d*. As can be seen, water is removed and reintroduced into the stock at several locations along the blade.

While the invention has been described in connection with what is considered to be the most practical and preferred embodiment, it should be understood that this invention is not limited to the disclosed embodiments, but on the contrary, is intended to cover various modifications and equivalent arrangements included within the spirit and scope of the appended claims.

The invention claimed is:

1. A drainage device for maintaining a plurality of hydrodynamic processes for proper drainage of liquid or water from a paper stock or fiber slurry transported on a fabric which passes over the device, and for reducing cross machine direction variations in paper sheet or fiber mat quality, the device comprising:

a primary blade having a leading edge support surface adjacent the fabric for support thereof and a trailing edge surface that diverges downwardly, away from the leading edge support surface;

a support blade located between the fabric and the primary blade which separates the fabric from the primary blade and forms a channel;

wherein the channel directs water drained from the paper stock into a controlled turbulence or a micro-activity zone formed between the primary blade and the fabric, wherein the drained water is reintroduced into the fiber slurry in part or completely.

2. The device according to claim 1, wherein the primary blade is flat.

3. The device according to claim 1, wherein the primary blade comprises one or more steps.

4. The device according to claim 3, wherein the step is formed on the trailing edge of the primary blade.

5. The device according to claim 3, wherein the steps are sized according to a thickness of the paper stock and a velocity of the device.

6. The device according to claim 1, wherein the primary blade comprises one or more divergent and convergent sections.

7. The device according to claim 6, wherein the divergent and convergent sections are formed on the trailing edge of the primary blade.

8. The device according to claim 6, wherein the divergent section makes an angle $\alpha$ with the horizontal and the convergent section makes an angle $\beta$ with the horizontal.

9. The device according to claim 8, wherein angle $\alpha$ and angle $\beta$ are between 0.1 and 10 degrees.

10. The device according to claim 1, wherein the primary blade comprises a combination of steps, divergent and convergent sections.

11. The device according to claim 1, wherein the primary blade is elongated and comprises a plurality of micro-activity zones.

12. A method of draining liquid from paper stock contained on a fabric in a papermaking machine comprising the following steps:

providing a drainage device comprising a primary blade having a leading edge support surface adjacent the fabric for support thereof and a trailing edge surface that diverges downwardly away from the leading edge support surface forming a channel between the fabric and the trailing edge surface;

providing a support blade between the fabric and the primary blade which separates the fabric from the primary blade and forms a channel; and directing liquid drained from the paper stock into the channel and a controlled turbulence or a micro-activity zone formed between the primary blade and the fabric so as to allow at least a portion of the drained liquid to be forced back through the fabric into the paper stock.

13. A device usable with a forming board or a drainage system, the device comprising:

a forming fabric on which a fiber slurry is conveyed; the forming fabric having an outer surface and an inner surface; and a primary blade having a leading edge support surface that is flat and parallel and in sliding contact with the inner surface of the forming fabric, and a trailing edge surface that slopes away from the leading edge at an angle following the leading edge, thereby transporting water drained from the fiber slurry into a controlled turbulence or a micro-activity zone formed below the forming fabric;

a support blade disposed between the fabric and the primary blade and forms a channel that directs the water drained from the paper stock into the controlled turbulence or micro-activity zone; and wherein the angle of the trailing edge with respect to the leading edge is in the range of 0.1 to 10 degrees.

14. The device according to claim 13, wherein the primary blade comprises an offset plane in order to retain water for activity improvement and control.

15. The device according to claim 13, wherein the support blade allows free flow of water through the channel.

16. The device according to claim 13, wherein the leading edge of the primary blade angles away from the forming fabric with the activity zone formed of a converging and diverging section with or without a pivot point.

17. The device according to claim 13, wherein the support blade is insertable into the body of the machine in one piece, thereby facilitating easy installation.

18. The device according to claim 13, wherein the drained water is re-used in at least a part of the forming process in order to produce a desired hydrodynamic effect.

19. A method of maintaining one or more hydrodynamic processes involved in paper manufacture, the method comprising the steps of:

providing a device comprising a primary blade having a leading edge support surface that is flat and parallel and in sliding contact with the inner surface of the forming fabric, and a trailing edge surface that slopes away from the leading edge at an angle following the leading edge, thereby leading water drained from the fiber slurry into a controlled turbulence or a micro-activity zone formed below the forming fabric;

providing a support blade between the fabric and the primary blade and forms a channel that directs the water drained from the paper stock into a controlled turbulence or micro-activity zone; and wherein the angle of the trailing edge with respect to the leading edge is in the range of 0.1 to 10 degrees.

20. The method according to claim 19, wherein the leading edge of the primary blade angles away from the forming fabric with the activity zone formed of a converging and diverging section with or without a pivot point.

21. The method according to claim 19, wherein the support blade can be inserted into the body of the machine in one piece, thereby facilitating easy installation.

* * * * *